US008112021B2

(12) United States Patent
Mochizuki

(10) Patent No.: US 8,112,021 B2
(45) Date of Patent: Feb. 7, 2012

(54) IMAGE FORMING APPARATUS HAVING MECHANISM FOR CORRECTING PULL OF BELT MEMBER

(75) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 909 days.

(21) Appl. No.: 12/138,153

(22) Filed: Jun. 12, 2008

(65) Prior Publication Data

US 2008/0310891 A1 Dec. 18, 2008

(30) Foreign Application Priority Data

Jun. 13, 2007 (JP) ..... 2007-156394

(51) Int. Cl.
*G03G 15/01* (2006.01)

(52) U.S. Cl. ..... 399/302

(58) Field of Classification Search ..... 399/165, 399/302, 303, 308, 312, 329
See application file for complete search history.

(56) References Cited

U.S. PATENT DOCUMENTS

| | | | | |
|---|---|---|---|---|
| 5,765,082 | A * | 6/1998 | Numazu et al. | 399/299 |
| 6,324,374 | B1 | 11/2001 | Sasamoto et al. | |
| 7,082,282 | B2 * | 7/2006 | Kaneko | 399/309 |
| 7,643,781 | B2 * | 1/2010 | Sakashita et al. | 399/302 |
| 2003/0219288 | A1 * | 11/2003 | Hagiwara et al. | 399/299 |
| 2005/0244197 | A1 * | 11/2005 | Sasamoto et al. | 399/299 |

FOREIGN PATENT DOCUMENTS

| | | | |
|---|---|---|---|
| JP | 2000-266139 | A | 9/2000 |
| JP | 2002-173245 | A | 6/2002 |
| JP | 2002-182485 | A | 6/2002 |
| JP | 2002182486 | A * | 6/2002 |
| JP | 2002287527 | A * | 10/2002 |
| JP | 2003-337454 | A | 11/2003 |
| JP | 2004-117426 | A | 4/2004 |
| JP | 2005-062642 | A | 3/2005 |
| JP | 2005326638 | A * | 11/2005 |

* cited by examiner

*Primary Examiner* — Robert Beatty
(74) *Attorney, Agent, or Firm* — Canon USA Inc IP Division

(57) ABSTRACT

An image forming apparatus that adjusts an inclination angle of a supporting roller for regulating pulling of a belt member serving as an intermediate transfer belt or a recording-material supporting belt. The image forming apparatus changes a method of adjusting an inclination angle of the supporting roller in accordance with a winding angle of the belt member with respect to the supporting roller.

18 Claims, 13 Drawing Sheets

IMAGE FORMING APPARATUS HAVING MECHANISM FOR CORRECTING PULL OF BELT MEMBER

BACKGROUND OF THE INVENTION

1. Field of the Invention

The present invention relates to an image forming apparatus, such as a copying machine or a printer, using an electrophotography method or an electrostatic recording method. More particularly, the present invention relates to an image forming apparatus including a pull controlling mechanism of a recording-material supporting belt or of an intermediate transfer belt, disposed adjacent to an image bearing member that bears a toner image.

2. Description of the Related Art

Hitherto, for example, as a color image forming apparatus capable of forming a full-color image, the following image forming apparatuses of a direct transfer type or an intermediate transfer type are known. In the direct transfer type, toner images formed on a plurality of photosensitive drums are transferred onto a transfer member that is supported by a rotatable belt member (hereunder referred to as "transfer belt") serving as a supporting member that supports the transfer member. In the intermediate transfer method, toner images formed on a plurality of photosensitive drums are subjected to a primary transfer operation, that is, are temporarily transferred onto a rotatable belt member (hereunder referred to as "intermediate transfer belt") serving as an intermediate transfer member. Then, the toner images on the intermediate transfer belt are subjected to a secondary transfer operation, that is, are transferred onto a recording material. The intermediate transfer method facilitates forming of an image on various transfer members, and can increase selectivity of recording materials.

Control of Pull of Belt Member

When the image forming apparatus is operating, it is possible for any of these belt members to meander, and to become pulled from its predetermined position when, for example, a difference in the perimeter of the belt member, itself, or a misalignment between a plurality of belt supporting rollers occurs, due to, for example, a deformation of a main body of the apparatus.

As a method of correcting the belt pull, Japanese Patent Laid-Open No. 2000-266139 discusses a method of detecting a pull amount of a belt by detecting the position of an edge of the belt, and correcting an inclination angle of one of the supporting rollers on the basis of detection information. This method makes it possible to considerably increase belt life with less mechanical stress compared to a method that controls a rib-like rubber adhered to a belt edge or that controls the belt edge by directly abutting it against, for example a flange.

FIG. 15 schematically shows a related image forming apparatus using an intermediate transfer method. Four process units, which are image forming devices, are provided in correspondence with respective colors, yellow, magenta, cyan, and black. Reference numerals 1*a* to 1*d* denote photosensitive drums, reference numerals 2*a* to 2*d* denote changing devices, reference numerals 3*a* to 3*c* denote exposing devices, symbols 4*a* to 4*d* denote developing devices, reference numeral 51 denotes an intermediate transfer belt, reference numerals 53*a* to 53*d* denote primary transfer members, and reference numerals 6*a* to 6*d* denote photosensitive drum cleaners. Reference numeral 55 denotes a steering roller, reference numeral 56 denotes a driving roller for rotating the intermediate transfer belt, reference numerals 56 and 57 denote secondary transfer members, and reference numeral 140 denotes a belt edge detector.

In the image forming apparatus shown in FIG. 15, a pull amount of the intermediate transfer belt 51 is detected by the belt edge detector 140, and an inclination angle of the steering roller 55 is adjusted. In an inclination angle method, either one of two axes at respective ends of the steering roller is moved in the direction of the arrow shown in FIG. 15 (that is, substantially vertically).

Separation of Intermediate Transfer Belt

In a color image forming apparatus, an image may be formed using any one of the image bearing members. That is, an image may be formed using only one color, such as black. Here, if, for example, consumption of the image bearing members or other related members is considered, it is desirable that the image bearing members for the other colors not involved in the image formation be stopped. However, if the other photosensitive drums are stopped during rotation of the intermediate transfer belt, the photosensitive drums are scratched due to rubbing. In contrast, Japanese Patent Laid-Open Nos. 2004-117426, 2005-62642, 2002-173245, and 2003-337454 discuss a structure in which image bearing members other than a black image bearing member are separated from a transfer belt or an intermediate transfer belt when only a black image is to be formed.

The structure of separating the intermediate transfer belt will be described using FIG. 16. An image forming apparatus shown in FIG. 16 has a structure that is the same as that of the image forming apparatus shown in FIG. 15. FIG. 16 shows a state in which a primary transfer section is separated.

First, when a full-color image is to be formed, after uniformly charging photosensitive drums 1*a* to 1*d* by charging devices 2*a* to 2*d*, the photosensitive drums 1*a* to 1*d* are subjected to exposure by exposing devices 3*a* to 3*d* in accordance with an image signal, so that electrostatic latent images are formed on the photosensitive drums 1*a* to 1*d*. Thereafter, toner images are developed by developing devices 4*a* to 4*d*, so that the toner images on the photosensitive drums 1*a* to 1*d* are successively transferred onto an intermediate transfer belt 51 by applying a transfer bias to transfer members 53*a* to 53*d* from a transfer high-voltage source (not shown). At this time, by disposing a regulating roller 58, which regulates the position of the intermediate transfer belt, at a position A (indicated by a broken line), the intermediate transfer belt is disposed in contact with the photosensitive drums of the four colors (as indicated by a broken line). Transfer residual toner remaining on the photosensitive drums 1*a* to 1*d* is collected by photosensitive drum cleaners 6*a* to 6*d*. The images that are successively multiplexed and transferred onto the intermediate transfer belt 51 from the respective photosensitive drums in the aforementioned manner are transferred onto a recording material P by applying a secondary transfer bias between secondary transfer members 56 and 57. Fixing the toner images on the recording material P by a fixing device 7 causes the full-color image to be formed.

When a black single-color image is to be formed, for separating the intermediate transfer belt from the photosensitive drums 1*a*, 1*b*, and 1*c* (used to form yellow, magenta, and cyan images, respectively), the regulating roller 58, which regulates the position of the intermediate transfer belt, is disposed at a position B. This causes the intermediate transfer belt to be disposed at a position indicated by a solid line in FIG. 16. The black single-color image is only formed on the photosensitive drum 1*d*, and is transferred by the transfer member 53*d*, to obtain the single-color image. For preventing consumption of the photosensitive drums 1*a*, 1*b*, and 1*c* (used to form images of the other three colors), the photosensitive drums 1*a*, 1*b*, and 1*c* are stopped.

However, in the image forming apparatus, as also discussed in Japanese Patent Laid-Open No. 2002-173245, when the roller that regulates the position of the intermediate transfer belt is moved for separating the intermediate transfer belt from the photosensitive drums, a winding angle of the intermediate transfer belt 51 with respect to the steering roller 55 changes. This also changes the relationship between the inclination angle of the steering roller 55 and the magnitude of a force applied to the intermediate transfer belt 51 by the steering roller 55.

That is, as shown in FIG. 16, the winding angle with respect to the steering roller 55 is smaller when the intermediate transfer belt 51 (indicated by the broken line) is in contact with the photosensitive drums 1*a* to 1*c* than when the intermediate transfer belt 51 (indicated by the solid line) is separated from the photosensitive drums 1*a* to 1*c*.

When the winding angle is reduced, the area of a portion of the intermediate transfer belt 51 that is wound upon the steering roller 55 is reduced, so that the force that the intermediate transfer belt 51 receives from the steering roller 55 is reduced. As a result, the pull of the belt is not quickly corrected, thereby making it difficult to overcome image distortion or color misregistration.

To overcome this problem, the inclination angle with respect to the steering roller 55 may be set large so that a sufficient amount of force is applied to the intermediate transfer belt 51 to correct the pull even if the winding angle of the intermediate transfer belt (indicated by the broken line) with respect to the steering roller 55 becomes small as a result of the intermediate transfer belt coming into contact with the photosensitive members.

However, in the case in which the correction of the pull is performed at the same inclination angle when the winding angle of the intermediate transfer belt 51 (indicated by the solid line) with respect to the steering roller 55 becomes large as a result of the intermediate transfer belt 51 being separated from the photosensitive drums 1, the force received by the intermediate transfer belt 51 from the steering roller 55 becomes too large. As a result, the life of the intermediate belt may be reduced due to, for example, streaks, folds, or breakage in a surface of the belt member resulting from material deterioration of the belt member.

SUMMARY OF THE INVENTION

It is desirable to perform a proper belt pull controlling operation even if the state of the belt, e.g. the amount of belt that is wound upon a supporting member, changes.

An image forming apparatus according to an aspect of the present invention includes a first image bearing member and a second image bearing member, a belt member, a moving member, a supporting roller, and a supporting roller inclination device. Toner images being formed on the first and second image bearing members. The belt member is capable of contacting the first and second image bearing members. The moving member is configured to move a surface of the belt member to produce a first state, in which the belt member contacts the first and second image bearing members, and a second state, in which the belt member contacts the second image bearing member and separates from the first image bearing member. The supporting roller rotatably contacts the belt member. An area of contact of the supporting roller and the belt member is changed by the movement of the moving member. The supporting roller inclination device is configured to incline the supporting roller to move the belt member in a rotational axis direction of the supporting roller. An inclination angle of the supporting roller with respect to a predetermined belt position while the area of contact of the supporting roller and the belt member is small is larger than an inclination angle of the supporting roller with respect to the predetermined belt position while the area of contact of the supporting roller and the belt member is large.

Further features of the present invention will become apparent from the following description of exemplary embodiments with reference to the attached drawings.

DESCRIPTION OF THE EMBODIMENTS

An image forming apparatus according to the present invention will now be described in detail with reference to the drawings.

First Embodiment

Overall Structure and Operation of Image Forming Apparatus

Figure 1:
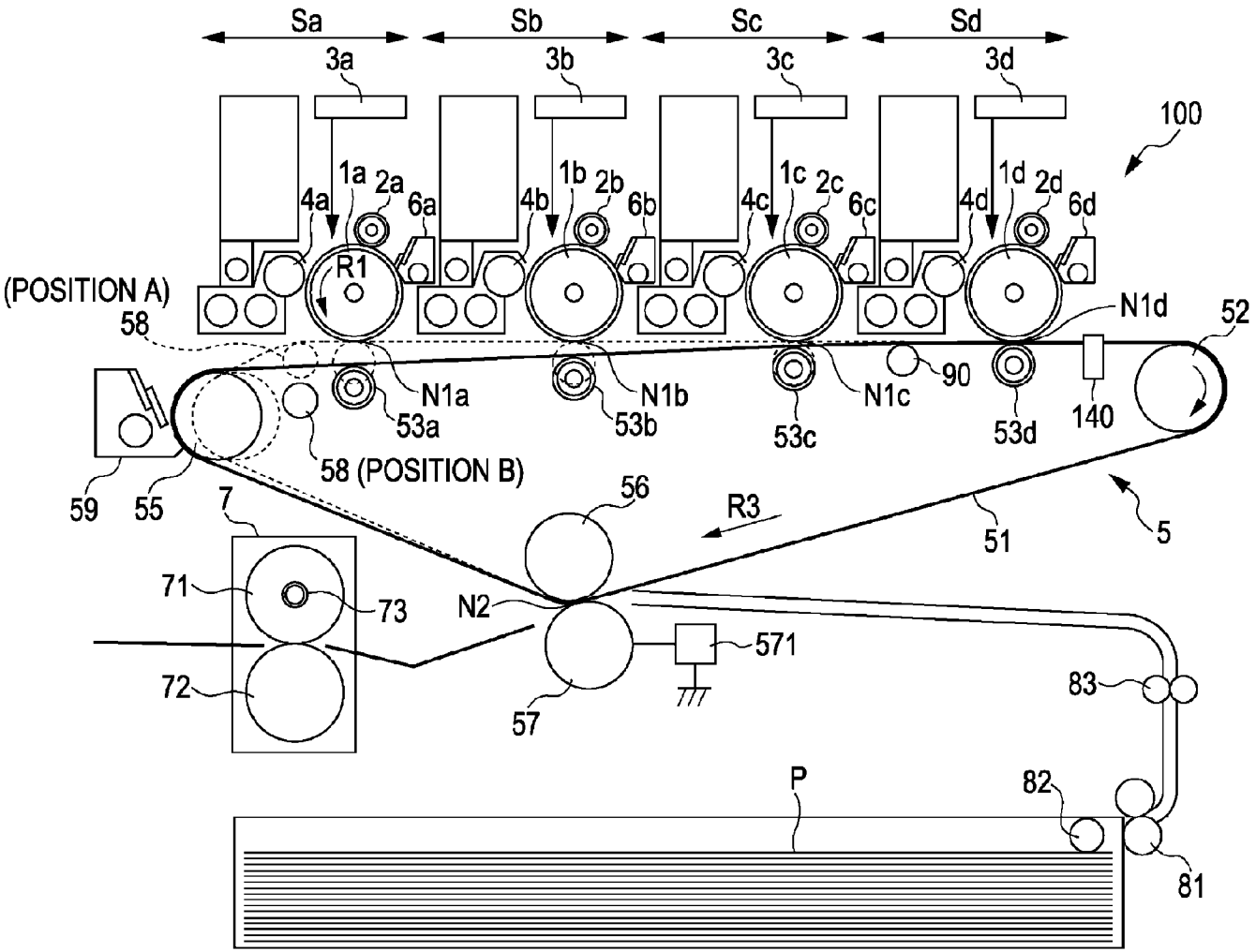
FIG. 1 is a schematic sectional view of the structure of an image forming apparatus according to a first embodiment of the present invention.

First, the overall structure and operation of an image forming apparatus according to a first embodiment of the present invention will be described. FIG. 1 is a schematic sectional view of the structure of an image forming apparatus 100 according to the first embodiment. The image forming apparatus 100 according to the embodiment is a full-color electrophotography image forming apparatus using an intermediate transfer method and including four photosensitive drums.

The image forming apparatus 100 includes a plurality of image forming sections (process units), that is, a first image forming section Sa, a second image forming section Sb, a third image forming section Sc, and a fourth image forming section Sd. The image forming sections Sa, Sb, Sc, and Sd are provided for forming respective colors, yellow, magenta, cyan, and black.

In the embodiment, the structures of the image forming sections Sa to Sd are substantially the same, and only differ in the toner colors that they use. Therefore, when it is not necessary to particularly distinguish between them, the letters a, b, c, and d, included in their symbols to indicate what colors the image forming sections use, will be omitted, so as to generally describe the image forming sections.

The image forming sections S include respective photosensitive drums 1, serving as image bearing members. A charging roller 2 (serving as a primary charging device), a laser scanner 3 (serving as an exposing device), a developing device 4, a drum cleaner 6 (serving as a drum cleaning device), etc., are successively disposed around each photosensitive drum 1 in the direction of rotation of the corresponding photosensitive drum 1. In addition, an intermediate transfer belt 51, serving as a rotatable belt member, is disposed adjacent to the photosensitive drums 1*a* to 1*d* of the respective image forming sections Sa to Sd.

The intermediate transfer belt 51 is provided around a plurality of supporting members, that is, a driving roller 52, a steering roller 55, a secondary transfer inner roller 56, and an upstream regulating roller 58. The steering roller 55, which is a supporting roller, applies a stretching force for tightly stretching the intermediate transfer belt 51. A spring biasing device 555 biases both ends of the steering roller 55 substantially towards the left shown in FIG. 1. A driving force is transmitted to the intermediate transfer belt 51 by the driving roller 52 (serving as a belt driving device), to rotate the intermediate transfer belt 51 in the direction of illustrated arrow R3.

The image forming apparatus according to the embodiment has a full color mode (first mode) and a black single-color mode (second mode). The intermediate transfer belt 51 is brought into or out of contact with the photosensitive drums in accordance with the mode. In the full color mode, the upstream regulating roller 58 (serving as a moving member) is disposed at a position A, so that the intermediate transfer belt 51 is disposed at a position indicated by a broken line in FIG. 1. In contrast, in the black single-color mode, the upstream regulating roller 58 is disposed at a position B, so that the intermediate transfer belt 51 retreats to a position indicated by a solid line in FIG. 1. In this way, the upstream regulating roller 58 moves perpendicularly to the direction of movement of the intermediate transfer belt 51, and moves a portion of a belt surface perpendicularly to the direction of movement of the intermediate transfer belt 51.

Primary transfer rollers 53*a* to 53*d* (serving as primary transfer members) are disposed at locations opposing the respective photosensitive drums 1*a* to 1*d* at an inner peripheral surface side of the intermediate transfer belt 51.

In the full color mode, the photosensitive drums 1*a*, 1*b*, and 1*c* (first image bearing members), and the photosensitive drum 1*d* (second image bearing member) are in contact with the intermediate transfer belt 51. That is, the first primary transfer rollers 53*a* to 53*d* are biased towards the respective photosensitive drums 1*a* to 1*d* through the intermediate transfer belt 51, so that primary transfer sections (primary transfer nip portions) N1*a* to N1*d*, where the photosensitive drums 1*a* to 1*d* and the intermediate transfer belt 51 contact each other, are formed.

In the black single-color mode, the intermediate transfer belt 51 separates from the photosensitive drums 1*a*, 1*b*, and 1*c* (where yellow, magenta, and cyan toner images are formed, respectively), and only contacts the photosensitive drum 1*d* (where a black toner image is formed). At this time, the transfer section N1*d* (where the black photosensitive drum 1*d* opposes the primary transfer roller 53*d*) is only formed. A secondary transfer outer roller 57 (serving as a secondary transfer member) is disposed at a location opposing the secondary transfer inner roller 56 at the outer peripheral surface side of the intermediate transfer belt 51. The secondary transfer outer roller 57 contacts the outer peripheral surface of the intermediate transfer belt 51, to form a secondary transfer section (secondary transfer nip portion) N2.

Images formed on the respective photosensitive drums 1*a* to 1*d* at the respective image forming sections Sa to Sd in the full color mode are successively multiplexed and transferred onto the intermediate transfer belt 51 that passes a region adjacent to the photosensitive drums 1*a* to 1*d*. Thereafter, the images transferred onto the intermediate transfer belt 51 are further transferred onto a transfer material P, such as paper, at the secondary transfer section N2.

Figure 2:
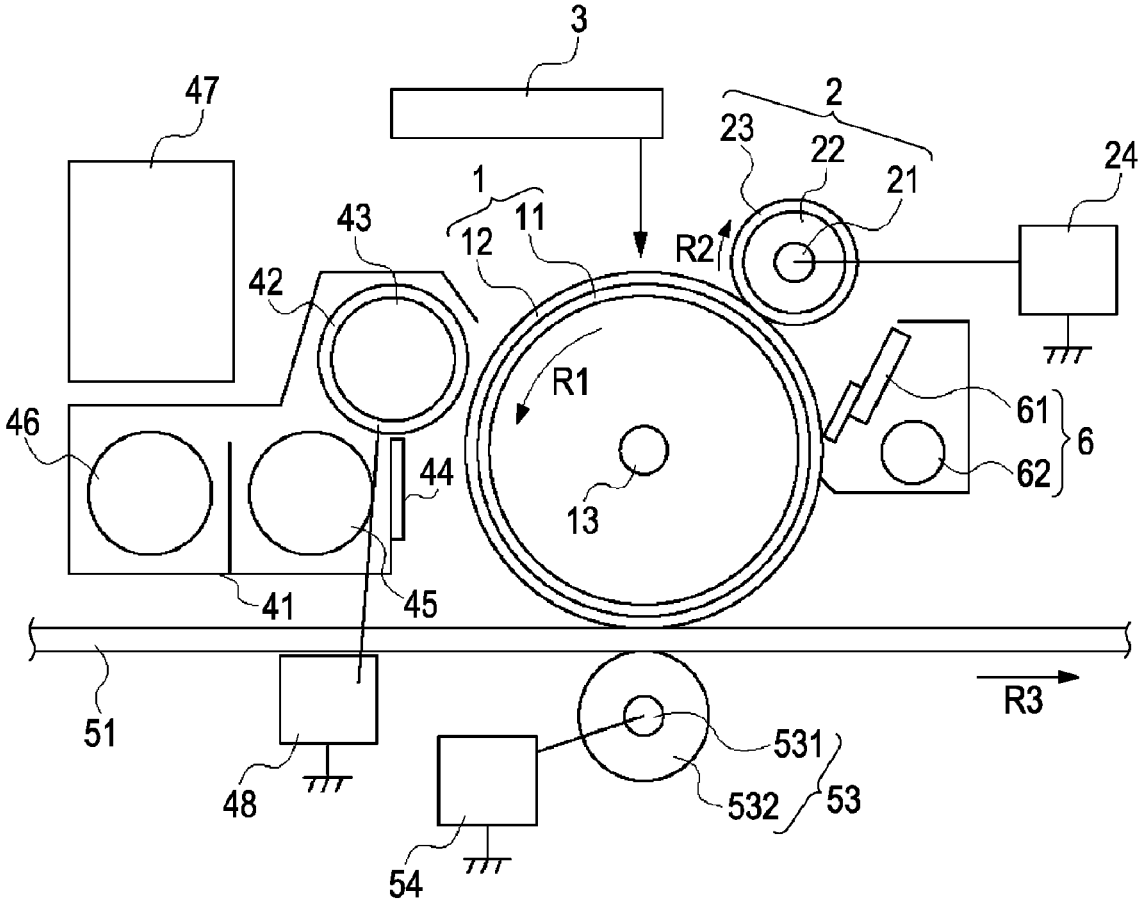
FIG. 2 is a schematic sectional view illustrating in more detail the structure of an image forming section of the image forming apparatus shown in FIG. 1.

FIG. 2 shows one of the image forming sections S in more detail. Further describing the image forming section S with reference to FIG. 2, the photosensitive drum 1 is rotatably supported by the main body of the image forming apparatus. The photosensitive drum 1 is a circular cylindrical electrophotography photosensitive member comprising a conductive base 11 (formed of, for example, aluminum) and a photoconductive layer 12 (formed around the outer periphery of the conductive base 11). The photosensitive drum 1 has a shaft 13 at its center. A driving device (not shown) rotationally drives the photosensitive drum 1 around the shaft 13 as a center in the direction of illustrated arrow R1. In the embodiment, the charge polarity of the photosensitive drum 1 is negative.

The charging roller 2, serving as a primary charging device, is disposed at the upper portion of the photosensitive drum 1 in FIG. 2. The charging roller 2 comes into contact with the surface of the photosensitive drum 1, and uniformly charges the surface of the photosensitive drum 1 to a predetermined polarity and electrical potential. The charging roller 2 comprises a conductive core metal 21, a low-resistance photoconductive layer 22, and an intermediate-resistance conductive layer 23. The core metal 21 is disposed at the center of the charging roller 21, and the low-resistance conductive layer 22 is formed around the outer periphery of the core metal 21, so that the charging roller 2 has a roller structure as a whole. In the charging roller 2, both ends of the core metal 21 are rotatably supported by a bearing (not shown), and are disposed parallel to the photosensitive drum 1. The bearing supporting these ends is biased towards the photosensitive drum 1 by a pressing device (not shown). Accordingly, the charging roller 2 press-contacts the surface of the photosensitive drum 1 by a predetermined pressing force. Rotation of the photosensitive drum 1 in the direction of illustrated arrow R1 causes the charging roller 2 to be driven and rotated in the direction of illustrated arrow R2. A charging bias voltage is applied to the charging roller 2 by a charging bias source 24 (serving as a charging bias outputting device). This causes the surface of the photosensitive drum 1 to be subjected to a uniform contact charging operation.

The laser scanner 3 is disposed downstream from the charging roller 2 in the direction of rotation of the photosensitive drum 1. The laser scanner 3 exposes the photosensitive drum 1 by scanning the photosensitive drum 1 while turning laser light on/off on the basis of image information. This causes an electrostatic image (latent image) to be formed on the photosensitive drum in accordance with the image information.

The developing device 4 is disposed downstream from the laser scanner 3 in the direction of rotation of the photosensitive drum 1. The developing device 4 includes a development container accommodating, as a developing agent, a two-component developing agent containing nonmagnetic toner particles (toner) and magnetic carrier particles (carrier). A development sleeve 42 (serving as a developing agent bearing member) is rotatably installed in an opening of the development container 41 facing the photosensitive drum 1. A magnet roller 43 (serving as a magnetic-field generating device) is fixedly disposed in the development sleeve 42 so as not to rotate when the development sleeve 42 rotates. The magnetic field generated by the magnet roller 43 causes the two-component developing agent to be borne on the development sleeve 42. A regulation blade 44, serving as a developing-agent regulation member that forms a thin layer by regulating the two-component developing agent borne on the development sleeve 42, is installed below the development sleeve 42 in FIG. 2. The inner portion of the development container 41 is divided into a development chamber 45 and an agitation chamber 46. A replenishing chamber 47 accommodating replenishing toner is provided above the development container 41 in FIG. 2.

Rotation of the development sleeve 42 causes the thin layer formed of the two-component developing agent and formed on the development sleeve 42 to be conveyed to a development area opposing the photosensitive drum 1. Then, the two-component developing agent on the development sleeve 42 stands up at the development area by magnetic force of a development main pole of the magnet roller 43 positioned at the development area, so that a magnetic brush of the two-component developing agent is formed. The surface of the photosensitive drum 1 is rubbed by the magnetic brush, and a development bias voltage is applied to the development sleeve 42 by a development bias source 48 (serving as a development bias outputting device). This causes the toner adhered to the carrier (forming the tip of the magnetic brush) to adhere to an exposure portion of the electrostatic image on the photosensitive drum 1, so that a toner image is formed. In the embodiment, the toner image is formed on the photosensitive drum 1 by reversal development in which the toner charged with the same charging polarity as that of the photosensitive drum 1 is adhered to a portion on the photosensitive drum where an electrical charge is reduced by the exposure of the photosensitive drum 1.

The primary transfer roller 53 is disposed below the photosensitive drum 1 in FIG. 2 so as to be situated downstream from the developing device 4 in the direction of rotation of the photosensitive drum 1. The primary transfer roller 53 comprises a core metal 531 and a circular cylindrical conductive layer 532, provided around the outer peripheral surface of the core metal 531. Both ends of the primary transfer roller 53 are biased towards the photosensitive drum 1 by a pressing member (not shown), such as a spring. This causes the conductive layer 532 of the primary transfer roller 53 to press-contact the surface of the photosensitive drum 1 through the intermediate transfer belt 51 by a predetermined pressing force. A primary transfer bias source 54 (serving as a primary transfer bias outputting device) is connected to the core metal 531. The primary transfer section N1 is formed between the photosensitive drum 1 and the primary transfer roller 53. The intermediate transfer belt 51 is interposed in the primary transfer section N1. The primary transfer roller 53 comes into contact with the inner peripheral surface of the intermediate transfer belt 51, and rotates as the intermediate transfer belt 51 moves. When an image is to be formed, a primary transfer bias voltage, whose polarity (second polarity, which is positive in the embodiment) is opposite to a normal charging polarity (first polarity, which is negative in the embodiment) of the toner, is applied to the primary transfer roller 53 by the primary transfer bias source 54. Then, an electrical field oriented in a direction that moves the toner having the first polarity towards the intermediate transfer belt 51 from the photosensitive drum 1 is formed. This causes the toner image on the photosensitive drum 1 to be transferred onto the surface of the intermediate transfer belt 51 (primary transfer operation).

Extraneous material, such as any remaining toner (primary-transfer remaining toner) on the surface of the photosensitive drum 1 after the primary transfer step, is cleaned off by the drum cleaner 6. The drum cleaner 6 comprises a cleaning blade 61 (serving as a cleaning member), a conveying screw 62, and a drum cleaner housing 63. The cleaning blade 62 contacts the photosensitive drum 1 at a predetermined angle and under a predetermined pressure by a pressing device (not shown). By this, for example, any toner remaining on the surface of the photosensitive drum 1 is scraped off and removed from the photosensitive drum 1 by the cleaning blade 62, and is collected in the drum cleaner housing 63. For example, the collected toner is conveyed by the conveying screw 62, and is discharged to a waste-toner container (not shown).

In FIG. 1, an intermediate transfer unit 5 is formed by disposing the intermediate transfer belt 51, the primary transfer rollers 53*a* to 53*d*, the secondary transfer inner roller 56, the secondary transfer outer roller 57, an intermediate transfer belt cleaner 59, etc., below the photosensitive drums 1*a* to 1*d*. The secondary transfer inner roller 56 is electrically connected to ground. A secondary transfer bias source 571, serving as a secondary transfer bias outputting device, is connected to the secondary transfer outer roller 57. The secondary transfer inner roller 56 contacts the inner peripheral surface of the intermediate transfer belt 51, and rotates as the intermediate transfer belt 51 moves.

For example, when a full color image is to be formed, toner images of respective colors are formed on the respective photosensitive drums 1*a* to 1*d* of the first to fourth image forming sections Sa to Sd. The toner images of the respective colors receive primary transfer biases from the respective primary transfer rollers 53 opposing the respective photosensitive drums 1*a* to 1*d* with the intermediate transfer belt 51 being interposed between the primary transfer rollers 53 and the respective photosensitive drums 1*a* to 1*d*. This causes the toner images to be successively transferred onto the intermediate transfer belt 51 (primary transfer). The toner images are conveyed to the secondary transfer section N2 due to the rotation of the intermediate transfer belt 51.

Up to this time, a transfer material P is conveyed to the secondary transfer section N2 by a transfer material supplying device 8. That is, at the transfer material supplying device 8, transfer materials P that are taken out one at a time by a pickup roller 82 from a cassette 81 (serving as a transfer material container) are conveyed to the secondary transfer section N2 by, for example, a conveying roller 83.

In the embodiment, when an image is to be formed, a secondary transfer bias voltage, whose polarity (second polarity, which is positive in the embodiment) is opposite to a normal charging polarity (first polarity, which is negative in the embodiment) of the toner, is applied to the secondary transfer outer roller 57 by the secondary transfer bias source 571. Then, an electrical field oriented in a direction that moves the toner having the first polarity towards the transfer material P from the intermediate transfer belt 51 is formed between the secondary transfer inner roller 56 and the secondary transfer outer roller 57. This causes the toner image on the photosensitive drum 1 to be transferred onto the intermediate transfer belt 51 (secondary transfer). The transfer material P onto which the toner image has been transferred at the secondary transfer section N2 is conveyed to the fixing device 7.

Extraneous material, such as any remaining toner (secondary-transfer remaining toner) on the outer peripheral surface of the intermediate transfer belt 51 after the secondary transfer step is removed and collected by the intermediate transfer belt cleaner 59, which has a structure that is similar to that of the drum cleaner 6.

The fixing device 7 includes a rotatably disposed fixing roller 71, and a pressing roller 72, which rotates while press-contacting the fixing roller 71. A heater 73, such as a halogen lamp, is disposed in the fixing roller 71. By controlling, for example, a voltage applied to the heater 73, the temperature of the surface of the fixing roller 71 is adjusted. When a transfer material P is conveyed to the fixing device 7, and passes between the fixing roller 71 and the pressing roller 72, which rotate at a constant speed, substantially constant pressure and heat are applied to the transfer material P from both front and back surfaces thereof. This causes the unfixed toner images on the surface of the transfer material P to be fused and fixed to the transfer material P. Accordingly, a full color image is formed on the transfer material P.

In the embodiment, a process speed corresponding to a speed of movement of a surface of the intermediate transfer belt 51 and that of the surface of the photosensitive drum 1 is 100 mm/sec.

Here, the intermediate transfer belt 51 may be formed of a dielectric resin, such as polycarbonate (PC), polyethylene terephthalate (PET), or polyvinylidene fluoride (PVDF). In the embodiment, the intermediate transfer belt 51 is formed of polyimide (PI) resin having a surface resistivity of $10^{12}\Omega/\square$ (probe conforming to JIS-K6911 used; applied pressure=100 V; application time=60 sec; 23° C./50% RH), and a thickness of 100 μm. However, the present invention is not limited thereto, so that other materials having different volume resistivities and thicknesses may be used. The steering roller 55 is a hollow cylindrical roller formed of aluminum, having an outside diameter of 30 mm, and having a wall thickness t=2 mm.

The upstream regulating roller 58 is a hollow cylindrical aluminum roller having an outside diameter of 16 mm and a wall thickness t=2 mm.

The primary transfer roller 53 comprises the core metal 531, having an outside diameter of 8 mm, and the conductive urethane sponge layer having a thickness of 4 mm. The electrical resistance of the primary transfer roller 53 is approximately $10^5\Omega$ (23° C./50% RH). The electrical resistance of the primary transfer roller 53 is determined from an electrical current value measured by rotating the primary transfer roller 53, which contacts a metallic roller connected to ground under a load of 500 g weight, at a peripheral speed of 50 mm/sec, and applying a voltage of 100 V to the core metal 531.

The secondary transfer inner roller 56 comprises a core metal 561, having an outside diameter of 18 mm, and a solid conductive silicone rubber layer, having a thickness of 2 mm. The electrical resistance of the secondary transfer inner roller 56 is approximately $10^4\Omega$, measured by the same measuring method as that used for the primary transfer roller 53. The secondary transfer outer roller 57 comprises a core metal 571, having an outside diameter of 20 mm, and a conductive EPDM rubber sponge layer 572, having a thickness of 4 mm. The electrical resistance of the secondary transfer outer roller 57 is approximately $10^8\Omega$, when the applied voltage is 2000 V in the same measuring method as that for the primary transfer roller 53.

Intermediate Transfer Belt Removing Mechanism and Operation of Steering Roller

Next, a mechanism for removing the intermediate transfer belt from the photosensitive drums 1*a*, 1*b*, and 1*c*, and the operation of the steering roller 55 caused by the removing mechanism will be described.

The image forming apparatus according to the embodiment includes the full color mode and the black single-color mode. The intermediate transfer belt 51 comes into contact with and separates from the photosensitive drums 1*a*, 1*b*, and 1*c* in accordance with the mode.

First, the operation of the image forming apparatus according to the embodiment when it forms an image in the black single-color mode will be described in detail. In the black single-color mode, in FIG. 1, the upstream regulating roller 58 is disposed at the position B, so that the intermediate transfer belt 51 is retreated to the solid line shown in FIG. 1. The intermediate transfer belt 51 only contacts the photosensitive drum 1*d*, so that the transfer nip portion N1*d* is formed. In addition, only a black single-color image is transferred onto the intermediate transfer belt 51. The winding angle of the intermediate transfer belt 51 at this time with respect to the steering roller 55 is larger than the winding angle in the full color mode (described later). That is, an area of contact of a portion of the intermediate transfer belt 51 that is wound upon the steering roller 55 is larger in the black single-color mode than in the full color mode.

Figure 3:
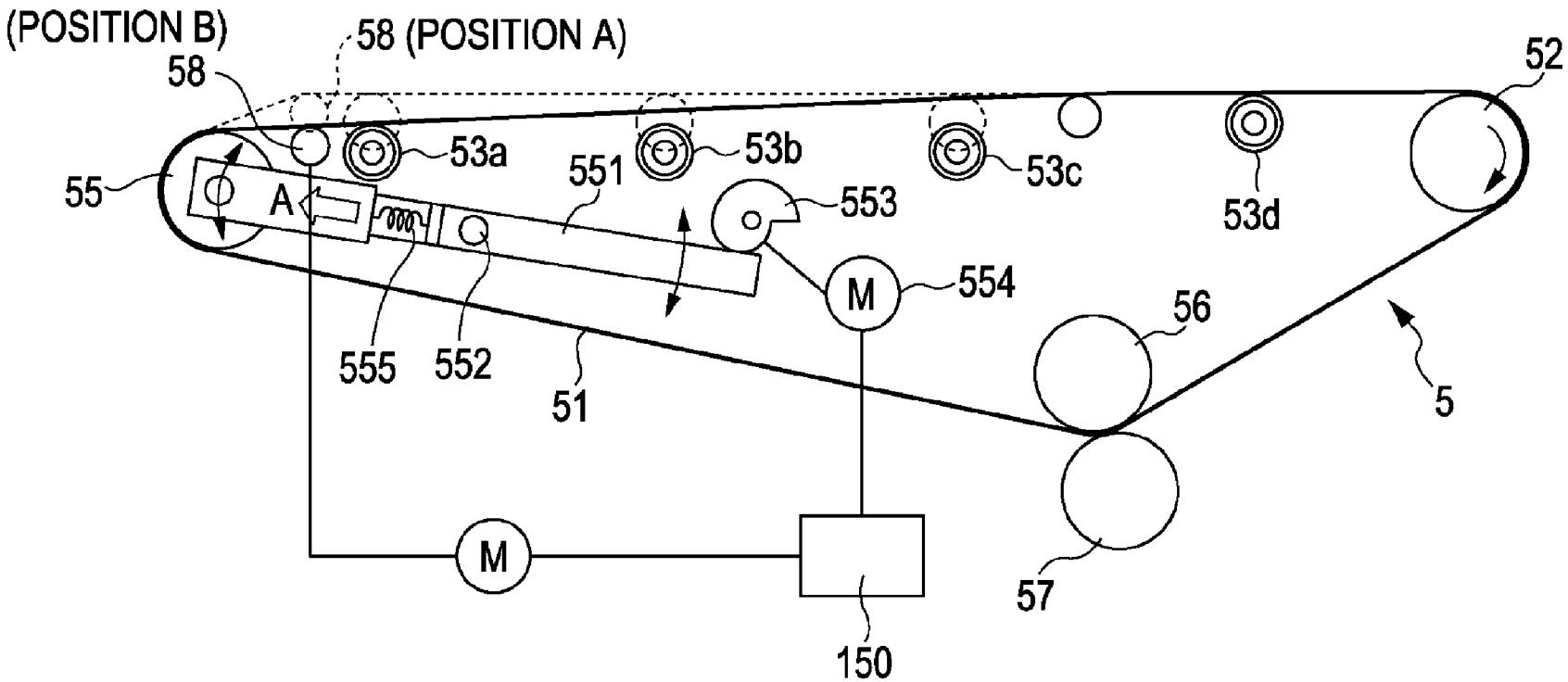
FIG. 3 shows the structure of a steering roller of the image forming apparatus according to the first embodiment of the present invention.

FIG. 3 shows a steering structure of the steering roller (supporting roller) 55 in the image forming apparatus according to the embodiment. A shaft end of the steering roller 55 at the front side of the main body is supported by a swinging arm 551 that swings around a swinging shaft 552 as a center. The position of the swinging arm 551 is regulated by a cam 553 (supporting roller inclination device). The vertical position of the shaft end of the steering roller 55 is determined on the basis of rotation of the cam 553. That is, when the cam 553 rotates clockwise by a steering motor 554, the shaft end of the steering roller 55 moves downward in FIG. 3, so that the inclination angle of the steering roller 55 is changed. In contrast, when the cam 553 rotates counterclockwise, the shaft end of the steering roller 55 moves upward in FIG. 3.

The steering roller 55 according to the embodiment also functions as a tension roller for applying stretching force to the intermediate transfer belt 51. The spring pressing member 555 applies tension in the direction of arrow A in FIG. 3.

Figure 4A:
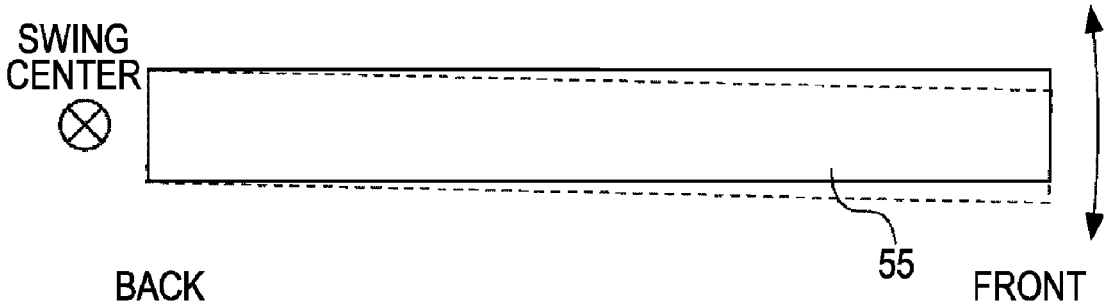
FIGS. 4A and 4B show a method of swinging the steering roller of the image forming apparatus according to the first embodiment of the present invention.
Figure 4B:
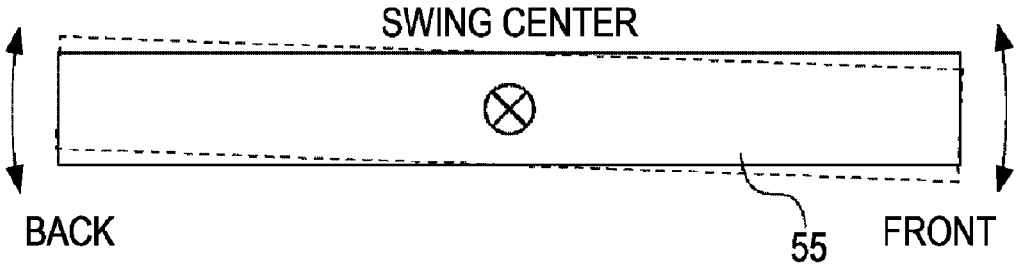

FIG. 4 shows a swing center of the steering roller 55. In FIG. 4A, the swing center is set at the back side of the main body, and the front side of the steering roller 55 moves vertically. In contrast, in FIG. 4B, the swing center is set at the center of the steering roller 55, and the front and back sides of the steering roller 5 swing vertically. The structure shown in FIG. 4A is suitable for finely controlling the inclination of the roller. The structure shown in FIG. 4B can restrict to a minimum the movement of the steering roller 55 in a direction in which the belt perimeter changes because the steering roller 55 is fixed at the center position. In the embodiment, the structure shown in FIG. 4A is used to perform a controlling operation with higher precision.

In the image forming apparatus according to the embodiment, as shown in FIG. 1, a belt edge detector 140 that detects the position of the intermediate transfer belt 51 in the rotational axial direction of the steering roller 55 is disposed near a front edge of the intermediate transfer belt 51. That is, the belt edge detector 140 detects the position of the intermediate transfer belt 51 in a direction perpendicular to the direction of rotation of the intermediate transfer belt 51. It is desirable that the belt edge detector 140 be provided at a location where a locus of the intermediate transfer belt 51 does not change when the intermediate transfer belt 51 comes into contact with and separates from the photosensitive drums 1*a*, 1*b*, and 1*c*. Accordingly, in the embodiment, the belt edge detector 140 is installed between the driving roller 52 and the transfer section N1*d* for black.

Figure 5A:
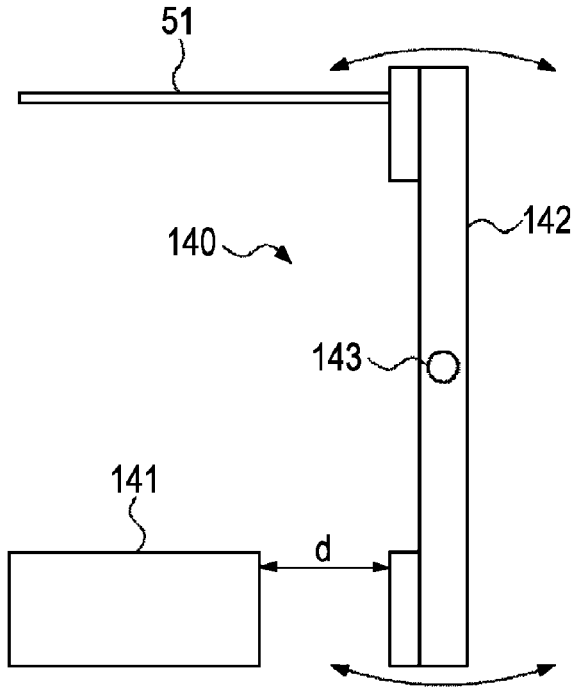
FIGS. 5A to 5C are schematic views of the structure of a belt edge detector of the image forming apparatus according to the first embodiment of the present invention.
Figure 5B:
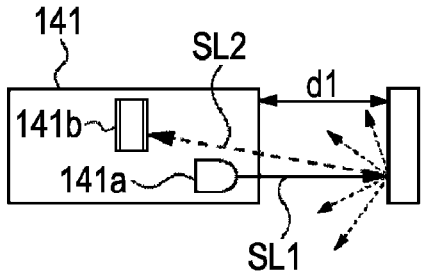
Figure 5C:
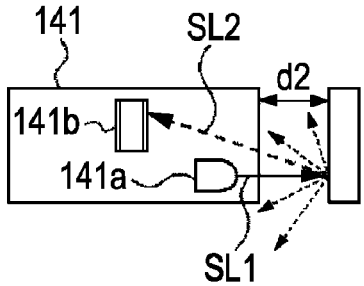

FIG. 5A shows the belt edge detector 140 as viewed from the left of FIG. 1. The belt edge detector 140 comprises a sensor arm 142, which can swing around a swinging shaft 143 as a center, and a displacement sensor 141. An edge of the intermediate transfer belt 51 contacts an end of the sensor arm 142, and the displacement sensor 141 is disposed at the opposite end of the sensor arm 142 so as to be separated by a predetermined interval therefrom. When the contact position of the edge changes, the sensor arm 142 swings, so that a distance d between the sensor arm 142 and the displacement sensor 141 changes. The sensor arm 142 is biased counterclockwise in FIG. 5 by a spring (not shown). The displacement sensor 141 outputs a predetermined voltage in accordance with the distance d. FIGS. 5B and 5C show the mechanism of the displacement sensor 141. In FIGS. 5B and 5C, symbol 141*a* denotes a light-emitting section, symbol 141*b* denotes a line sensor serving as a photodetector, symbol SL1 denotes a slit for transmitting light from the light-emitting section 141*a*, and symbol SL2 denotes a slit for transmitting the light from the light-emitting section 141*a* and scattered from a reflecting surface of the sensor arm 142. In FIG. 5B, when the distance between the sensor arm 142 and the displacement sensor 141 is d1, the light from the light-emitting section 141*a* is scattered by the reflecting surface of the sensor arm 142, passes through the slit SL2, and reaches the lower portion of the photodetector 141*b* in FIG. 5B, and is detected. In contrast, in FIG. 5C, when the distance between the sensor arm 142 and the displacement sensor 141 is d2, the scattered light that is transmitted through the slit SL2 and reaches the photodetector 141*b* corresponds to the upper portion in FIG. 5C. Accordingly, on the basis of the position where the scattered light reaches the line sensor (serving as the photodetector 141*b*), the displacement sensor 141 outputs a predetermined voltage in accordance with the distance d.

Figure 6:
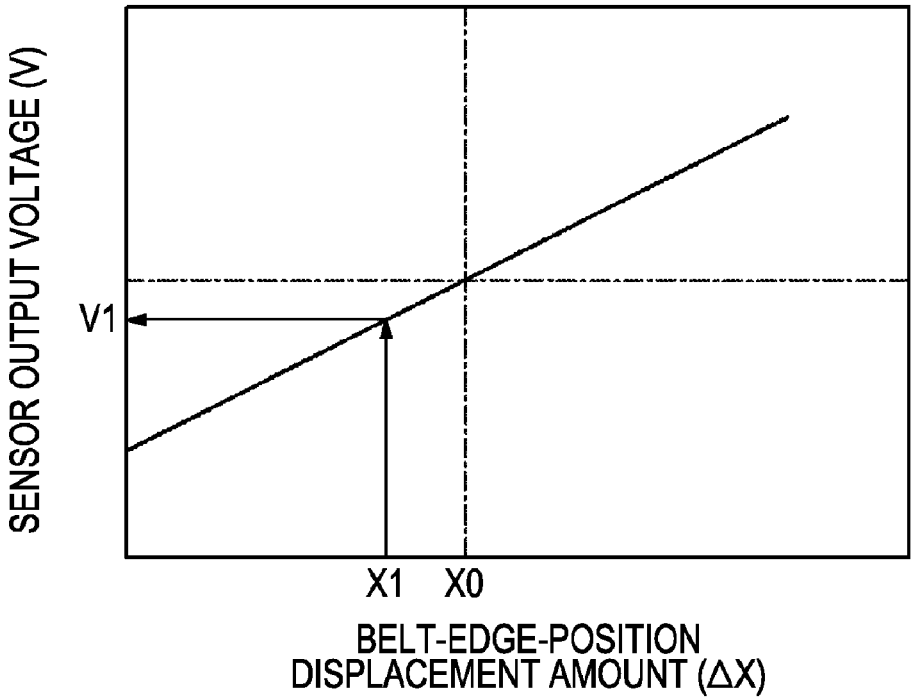
FIG. 6 is a diagram showing the relationship regarding output of the belt edge detector of the image forming apparatus according to the first embodiment of the present invention.

FIG. 6 shows the relationship between output voltage of the belt edge detector 140 and variation amount ΔX of the edge of the intermediate transfer belt 51 from a datum position X0. When the edge moves towards the back from the datum position X0, and reaches X1, the distance d between the sensor arm 142 and the displacement sensor 141 changes, so that a voltage V1 is output from the belt edge detector 140.

Figure 8:
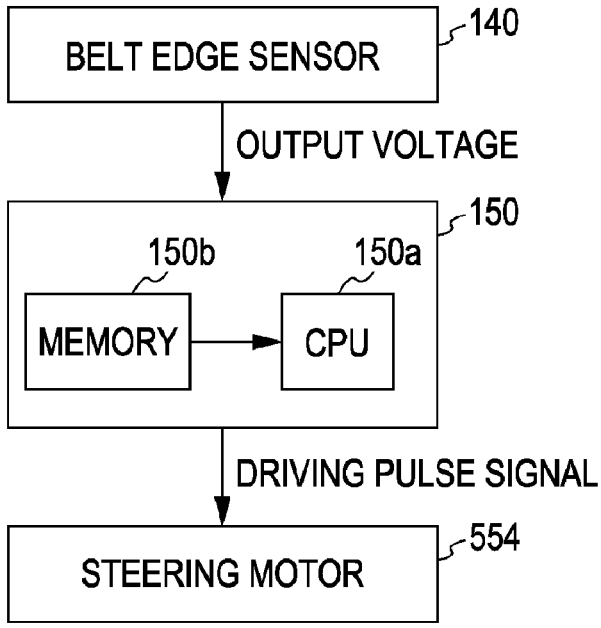
FIG. 8 is a block diagram illustrating positional control (pull control) in a rotational axis direction of the steering roller of the intermediate transfer belt of the image forming apparatus according to the first embodiment of the present invention.

A controlling device 150 shown in FIG. 8 includes a movement amount controlling section 150*a* that controls the movement amount of the belt. The number of driving pulses of the steering motor 554 with respect to information regarding the voltage output from the belt edge detector 140 is stored in a memory 150*b*. On the basis of the voltage information, the number of driving pulses of the steering motor 554 is determined by the movement amount controlling section 150*a* in a CPU. The steering motor 554 is a high-precision stepping motor, and its amount of rotation is controlled by the number of driving pulses.

Figure 7:
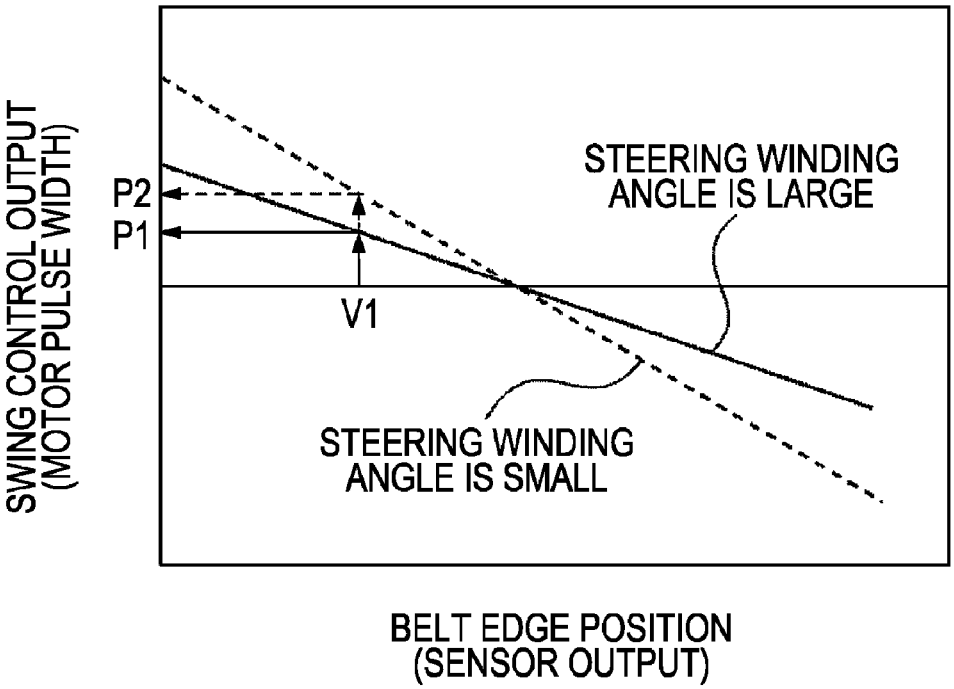
FIG. 7 is a diagram showing a control pulse of a steering motor of the image forming apparatus according to the first embodiment of the present invention.

FIG. 7 shows the relationship between the number of driving pulses of the steering motor 554 and the output voltage of the belt edge detector 140 in a processing carried out at the controlling device 150. The relationship in the black single-color mode is indicated by a solid line. When the voltage V1 is output from the belt edge detector 140, the controlling device 150 determines as P1 the number of driving pulses of the steering motor 554 required to rotate the cam 553 shown in FIG. 3 back to the datum position X0. A driving signal having the determined number P1 of driving pulses is transmitted to the steering motor 554, to rotate the steering motor 554. This causes the cam 553, provided at an output shaft end of the steering motor 554, to rotate counterclockwise, as a result of which the front axis of the tension roller 55 moves upward. Therefore, the intermediate transfer belt 51 moves towards the back as illustrated in the rotational axis direction of the steering roller 55.

This causes the intermediate transfer belt 51 to return to the datum position X0, and to reciprocate within a predetermined range with the datum position X0 as center.

By the aforementioned operations, in the black single-color mode, the relationship between the relative positions of the intermediate transfer belt 51 and the photosensitive drum 1*d* is maintained, thereby making it possible to mitigate the problems of image distortion or pulling of the belt.

Next, the operation of the image forming apparatus according to the embodiment when it forms an image in the full color mode will be described in detail. When an image is formed in the full color mode, the intermediate transfer belt is disposed as indicated by the broken line in FIG. 1. The intermediate transfer belt 51 come into contact with the photosensitive drums 1*a* to 1*d*, so that the transfer nip portions N1*a* to N1*d* are formed, and images of four colors are successively transferred. At this time, since the position of a surface of the intermediate transfer belt 51 is regulated so as to be parallel to the photosensitive drums 1*a* to 1*d*, the upstream regulating roller 58 is disposed at the position A shown in FIG. 1. As shown in FIG. 3, the upstream regulating roller 58 includes a switching controlling section for switching the upstream regulating roller 58 in accordance with an input mode (either the single-color mode or the full color mode) that is input to an input section in the controlling device 150. The switching controlling section causes a motor M to move the upstream regulating roller 58. The winding angle of the intermediate transfer belt 51 with respect to the steering roller 55 is smaller in the full-color mode than in the black single-color mode. That is, the area of a portion of the intermediate transfer belt 51 wound upon the steering roller 55 is relatively small.

In the image forming apparatus according to the embodiment, the winding angle of the intermediate transfer belt 51 with respect to the steering roller 55 is 165 degrees in the black single-color mode, and is 120 degrees in the full color mode. As a result, force applied to the intermediate transfer belt 51 from the steering roller 55 is smaller in the full color mode than in the black single-color mode.

This phenomenon can be explained as follows.

Figure 13A:
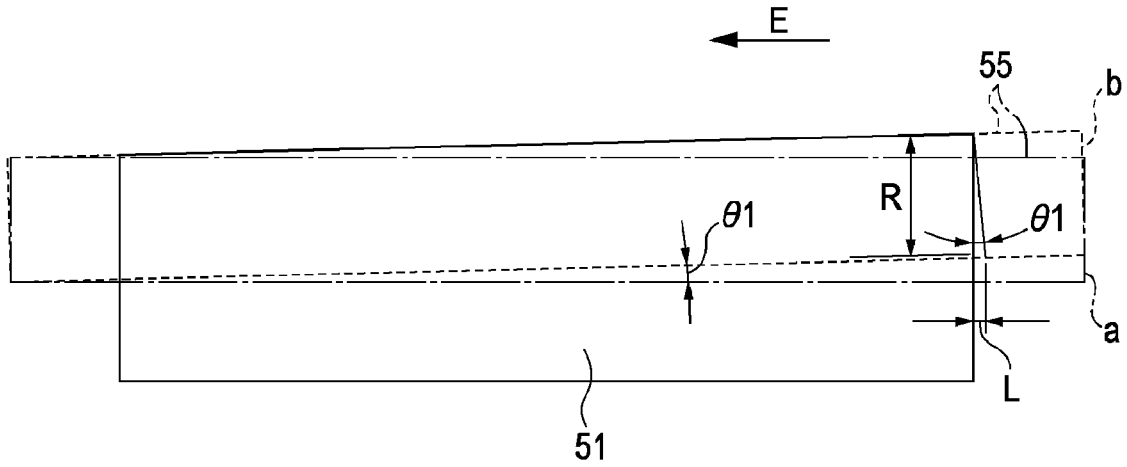
FIGS. 13A and 13B are schematic views illustrating the relationship between pull amount of an intermediate transfer belt and a steering roller.

FIG. 13A is a schematic view of the steering roller 55 of the image forming apparatus shown in FIG. 1 as seen from the left side of the apparatus. When the steering roller 55 is inclined from a position a to a position b by an angle of θ1°, the intermediate transfer belt 51 has an angle of θ1 with respect to the direction of rotation of the steering roller 55.

As a result, a force that acts towards the left in FIG. 13A, that is, towards the back in the apparatus shown in FIG. 1 acts upon the intermediate transfer belt 51.

Here, a movement amount L in which the intermediate transfer belt 51 moves in the rotational axis direction of the steering roller 55 (that is, direction of arrow E) while the steering roller 55 rotates once can be determined by the following Formula (1):

$$L=k\times R\times\tan\theta 1 \quad (1)$$

When the movement distance L is large, the force applied to the intermediate transfer belt 51 from the steering roller 55 is large. In Formula (1), θ1 denotes the inclination of the steering roller 55. In addition, R denotes the winding amount of the intermediate transfer belt 51 with respect to the steering roller 55, that is, the length of a portion of the intermediate transfer belt 51 that is wound upon the steering roller 55 in the direction of rotation of the steering roller 55. Further, k denotes a characteristic coefficient.

A micro-slip continuously occurs between the intermediate transfer belt 51 and the steering roller 55.

Since the movement amount L in which the intermediate transfer belt 51 moves in the rotational axis direction is determined while being influenced by the above, the characteristic coefficient k is defined as a coefficient that considers the influences of, for example, stretching force of the intermediate transfer belt 51 and coefficient of dynamic friction of the steering roller 55 and the intermediate transfer belt 51.

Figure 13B:
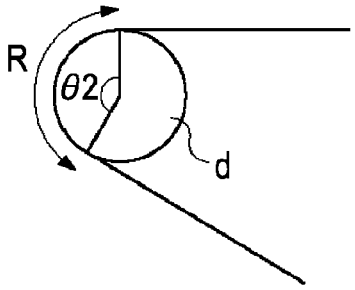

In FIG. 13A, for the sake of simplifying the description, a two-dimensional relationship between the steering roller 55 and the intermediate transfer belt 51 is illustrated. However, the intermediate transfer belt 51 actually has a three-dimensional winding amount R. FIG. 13B is a schematic view of the steering roller 55 of the image forming apparatus shown in FIG. 1 as seen from the front of the apparatus. When the steering roller 55 has a radius d, and when the winding angle is θ2°, the winding amount R of the intermediate transfer belt 51 is expressed by the relationship $R=2d\times\pi\times(\theta 2/360)$. Therefore, the aforementioned Formula 1 is rewritten as follows:

$$L=k\times 2d\times n\times(\theta 2/360)\times\tan\theta 1$$

That is, the movement amount L of the intermediate transfer belt 51 in the rotational axis direction of the steering roller 55 is a function of the winding angle θ2 of the intermediate transfer belt 51. The above explains why reducing the winding angle of the steering roller 55 reduces the movement amount L of the intermediate transfer belt 51 in the rotational axis direction of the steering roller 55.

In the image forming apparatus according to the embodiment, the problem that, for example, color misregistration or image distortion occurs as a result of reduction of the force applied to the intermediate transfer belt 51 from the steering roller 55 is overcome by the following method.

A broken straight line shown in FIG. 7 indicates the relationship between the number of driving pulses of the steering motor and output voltage of the belt edge detector 140 during the full color mode. As in the black single-color mode (solid line), the output voltage and the number of driving pulses are set in a proportional relationship as shown by the broken line, but the slope of the broken line is larger than the slope of the solid line.

In the full color mode, the winding angle with respect to the steering roller 55 is reduced, thereby reducing the force applied to the intermediate transfer belt 51 from the steering roller 55.

To compensate for this, the steering roller 55 is considerably inclined, to increase the force that the intermediate transfer belt 51 obtains from the steering roller 55.

The method of controlling the steering motor 554 is the same as that in the black single-color mode. When the belt edge detector 140 outputs the voltage V1, the controlling device 150 determines as P2 the number of driving pulses of the steering motor 554. A driving signal having the determined number P2 of pulses is transmitted to the steering motor 554, to rotate the cam 553, provided at the output shaft end of the steering motor 554, so that the position of the front side of the steering roller 55 is displaced to move the intermediate transfer belt 51 in the width direction thereof (perpendicular to the primary direction of belt movement during rotation) back towards the datum position X0 so as to tend to reduce the positional offset of the belt from the datum position.

Even in the operation in the full color mode, the relationship between the relative positions of the intermediate transfer belt 51 and the photosensitive drums 1*a* to 1*d* is maintained, thereby reducing the production of a poor image caused by image misregistration or color misregistration.

Figure 9:
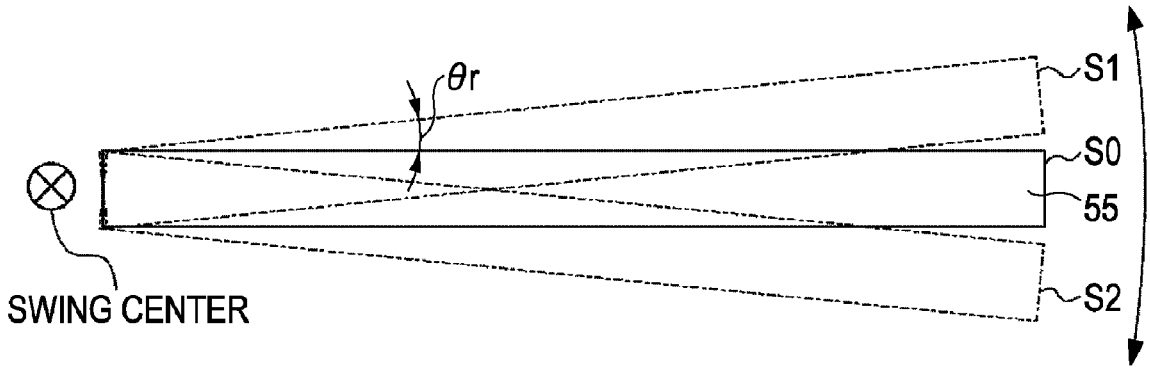
FIG. 9 illustrates inclination angles of the steering roller.

Here, in the embodiment, numerical values of an inclination angle θr of the steering roller 55 with respect to the variation amount ΔX of the intermediate transfer belt are shown in Tables 1 and 2. As shown in FIG. 9, the inclination angle θr is an angle with reference to S0, which is a swing center of the swinging of the steering roller 55. FIG. 9 shows the steering roller 55 of the image forming apparatus shown in FIG. 1 as seen from the left side of the apparatus. In FIG. 9, a position S1 is where the steering roller 55 is swung maximally to the upper side in FIG. 1, and a position S2 is where the steering roller 55 is swung maximally to the lower side shown in FIG. 1. The position S0 is positioned in the middle of the positions S1 and S2.

TABLE 1

| | WINDING ANGLE | VARIATION AMOUNT ΔX | INCLINATION ANGLE θr |
|---|---|---|---|
| FULL COLOR MODE | 120° | 20 μm | 0.08° |
| BLACK SINGLE-COLOR MODE | 165° | 20 μm | 0.05° |

TABLE 2

| | WINDING ANGLE | VARIATION AMOUNT ΔX | INCLINATION ANGLE θr |
|---|---|---|---|
| FULL COLOR MODE | 120° | 40 μm | 0.16° |
| BLACK SINGLE-COLOR MODE | 165° | 40 μm | 0.10° |

As shown in Table 1, when the intermediate transfer belt 51 is at a position at which the variation amount ΔX is 20 μm, the inclination angle θr is 0.08 degrees in the full color mode, whereas the inclination angle θr is 0.05 degrees in the black single-color mode.

As shown in Table 2, when the intermediate transfer belt 51 is at a position at which the variation amount ΔX is 40 μm, the inclination angle θr is 0.16 degrees in the full color mode, whereas the inclination angle θr is 0.10 degrees in the black single-color mode.

By the aforementioned controlling operation, the intermediate transfer belt 51 reciprocates between a point (one end), separated by 40 μm towards the front of the main body of the apparatus from the datum position X0, and another point (other end), separated by 40 μm towards the back of the main body of the apparatus from the datum position X0. During the reciprocation, a swing width for the inclination angle is 0.32 degrees in the full color mode, whereas a swing width for the inclination angle is 0.20 degrees in the black single-color mode.

In the embodiment, the position of the intermediate transfer belt 51 is controlled so that the swing width of the intermediate transfer belt 51 is within a maximum value of 40 μm on either side of the datum position X0. Therefore, the maximum inclination angle in the full color mode is greater than the maximum inclination angle in the back single-color mode.

Figure 10:
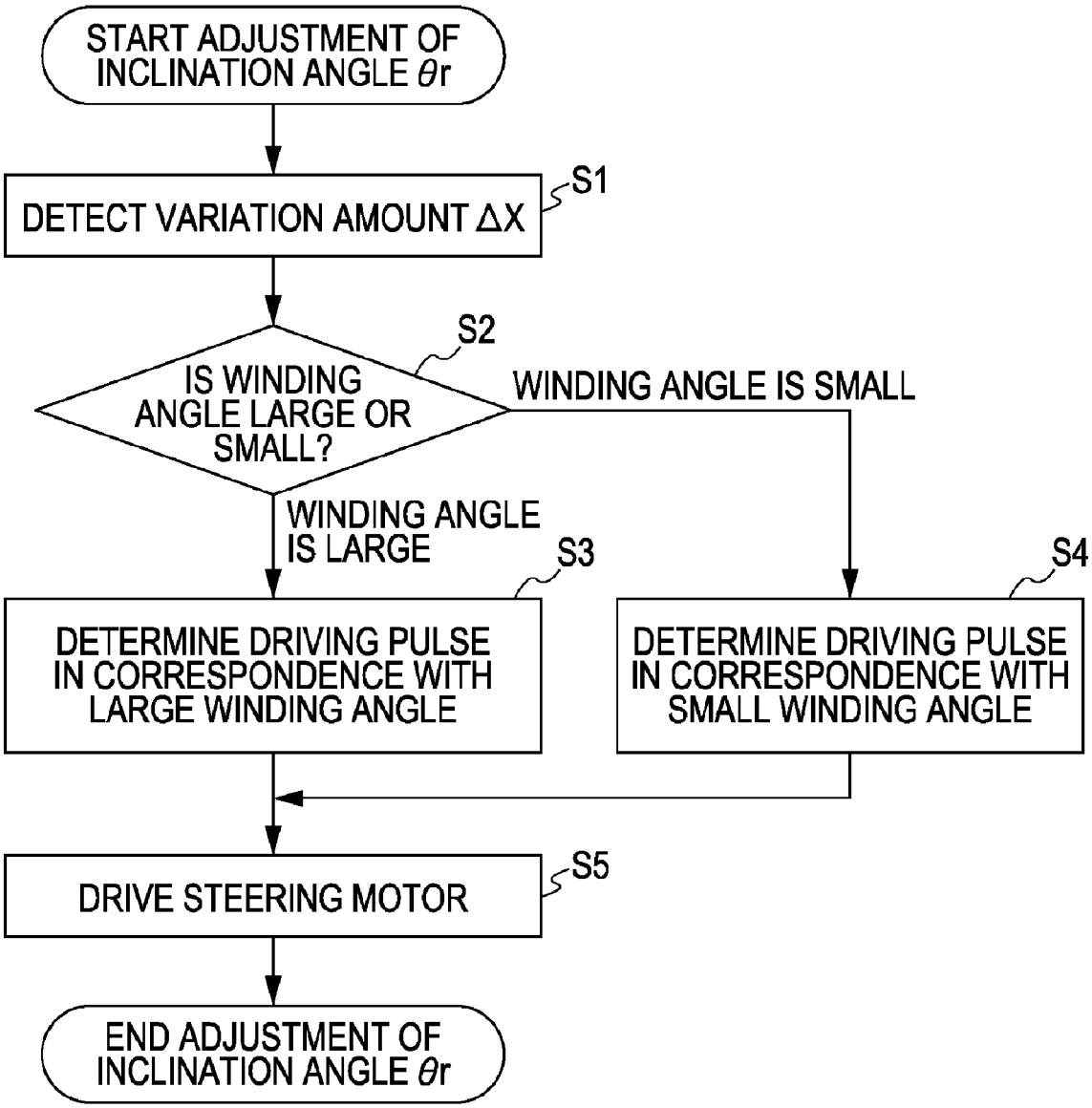
FIG. 10 is a flowchart illustrating the positional control (pull control) of the intermediate transfer belt in the rotational axis direction of the steering roller.

FIG. 10 is a flowchart illustrating adjustment of the inclination angle θr of the steering roller 55 in the embodiment. First, the belt edge detector 140 detects the variation amount ΔX from the datum position X0 of the edge of the intermediate transfer belt 51 (Step S1). Then, a determination is made as to whether the winding angle of the intermediate transfer belt 51 with respect to the steering roller 55 is large (in the monocolor mode) or is small (in the full color mode) (Step S2). Then, in accordance with the magnitude of the winding angle, the controlling device 150 determines a driving signal having a suitable number of driving pulses for driving the steering motor 554 (Steps S3 and S4). The steering motor is driven on the basis of the determined driving signal to adjust the inclination angle θr of the steering roller 55 (Step S5).

Second Embodiment

Another embodiment according to the present invention will now be described.

A second embodiment relates to an image forming apparatus using a belt edge detector (position detecting device) differing from that according to the first embodiment. However, since the structure of the image forming apparatus according to the second embodiment is substantially the same as that according to the first embodiment of the present invention, the details of the structure and operation thereof will be omitted, and only the differences will be described.

The image forming apparatus according to the second embodiment will be described with reference to FIG. 1. As with the image forming apparatus according to the first embodiment, the image forming apparatus according to the second embodiment is a full-color electrophotography image forming apparatus using an intermediate transfer method and including four photosensitive drums. In addition, in the image forming apparatus according to the second embodiment, as shown in FIG. 1, a belt edge detector 140 is provided at an front-side edge of an intermediate transfer belt 51.

Figure 11:
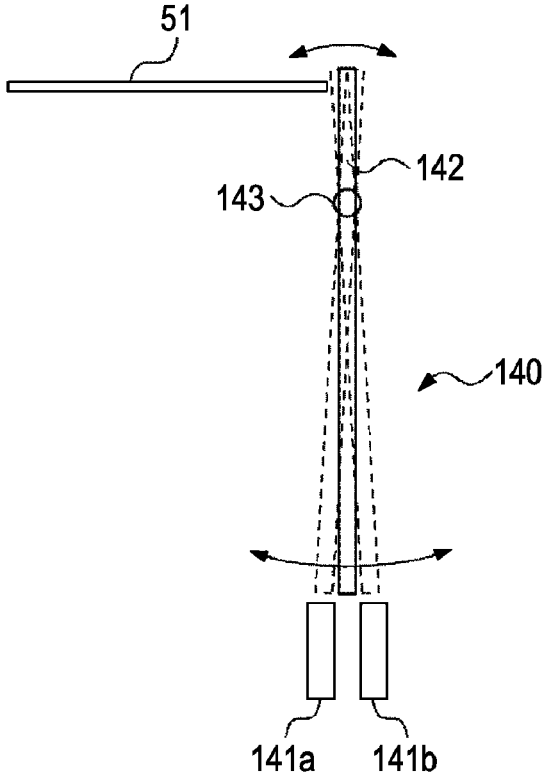
FIG. 11 is a schematic view showing the structure of a belt edge detector of an image forming apparatus according to a second embodiment of the present invention.

FIG. 11 shows the belt edge detector 140 used in the second embodiment as seen from the left of FIG. 1. The belt edge detector 140 comprises a sensor arm 142, which can swing around a swinging shaft 143 as a center, a displacement sensor 141*a*, and a displacement sensor 141*b*. An edge of the intermediate transfer belt 51 contacts an end of the sensor arm 142, and the displacement sensors 141*a* and 141*b* are disposed at the opposite end of the sensor arm 142. The sensor arm 142 according to the second embodiment is such that its displacement sensor 141*a* side and its displacement sensor 141*b* side are long with respect to the swinging shaft 143. A swing width of the intermediate transfer belt 51 that contacts the sensor arm 142 is amplified at the displacement sensor side. Further, the sensor arm 142 is biased counterclockwise in FIG. 11 by a spring (not shown). When an edge of the intermediate transfer belt 51 shifts towards the right in FIG. 11, the sensor arm 142 swings, so that the lower end of the sensor arm 142 moves so as to oppose the displacement sensor 141*a*. This causes the displacement sensor 141*a* to detect this movement. Similarly, when an edge of the intermediate transfer belt 51 shifts towards the left in FIG. 11, the displacement sensor 141*b* detects the movement, so that the position of the belt can be known.

Figure 12:
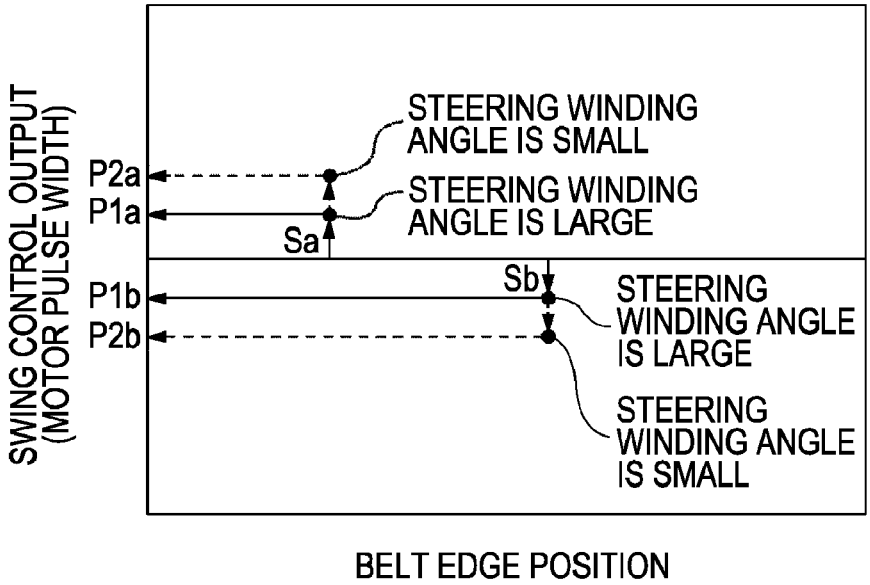
FIG. 12 is a diagram illustrating a control pulse of a steering motor of the image forming apparatus according to the second embodiment of the present invention.

FIG. 12 shows the relationship regarding the number of driving pulses of the steering motor for correcting the position of the steering roller when detection results of the belt edge detector 140 are provided.

First, a controlling operation in the black single-color mode will be described.

When the intermediate transfer belt 51 moves towards the front in the rotational axis direction of the steering roller 55 with respect to the datum position, and the belt edge detector 141*b* outputs a detection result, P1*a* is determined as the number of driving pulses of the steering motor 554 for rotating the cam 553 shown in FIG. 3. A driving signal having the determined number P1*a* of driving pulses is transmitted to the steering motor 554, so that the steering motor 554 rotates by the number P1*a* of pulses. This causes the cam 553, provided at the output shaft end of the steering motor 554, to rotate counterclockwise, as a result of which the front axis of the tension roller 55 moves upward, so that the intermediate transfer belt 51 moves towards the back in the rotational axis direction of the steering roller. Therefore, the intermediate transfer belt 51 returns to the datum position X0.

In contrast, when the intermediate transfer belt 51 moves towards the back with respect to the datum position X0, and the belt edge sensor 141*b* outputs a detection result, P1*b* is determined as the number of driving pulses of the steering motor for rotating the cam 553 shown in FIG. 3. In addition, by a similar controlling operation, the intermediate transfer belt 51 moves towards the front, and returns to the datum position X0.

Next, a controlling operation in the full color mode will be described. In the full color mode, the winding angle of the intermediate transfer belt 51 with respect to the steering roller 55 is smaller than that in the black single-color mode. Problems, such as color misregistration and image distortion, are overcome using the following method.

When the intermediate transfer belt 51 moves towards the front in the rotational axis direction of the steering roller with respect to the datum position X0, and the belt edge sensor 141*a* outputs a detection result, P2*a* is determined as the number of driving pulses of the steering motor for rotating the cam 553 shown in FIG. 3. The number P2*a* of driving pulses is larger than the number P1*a* of driving pulses. This increases the inclination angle of the steering roller 55 to compensate for the reduction in the winding angle of the intermediate transfer belt 51 with respect to the steering roller 55.

Similarly, when the intermediate transfer belt 51 moves towards the back with respect to the datum position X0, P2*b* is determined as the number of driving pulses of the steering motor, and the inclination angle of the steering roller 55 is adjusted. By the aforementioned operations, even in the full color mode, the relationship between the relative positions of the intermediate transfer belt 51 and the photosensitive drums 1*a* to 1*d* is maintained, thereby allowing an image to be formed while reducing image detects such as image misregistration or color misregistration.

As described above, in the image forming apparatus using the edge detecting device, the controlling of the inclination angle of the steering roller 55 is changed in accordance with a change in the winding angle of the intermediate transfer belt with respect to the steering roller, that is, a change in the area of a winding portion. As a result, it is possible to obtain an image forming apparatus that can reduce image misregistration without reducing the life of the belt.

Third Embodiment

Next, still another embodiment according to the present invention will now be described.

Overall Structure and Operation of Image Forming Apparatus

Figure 14:
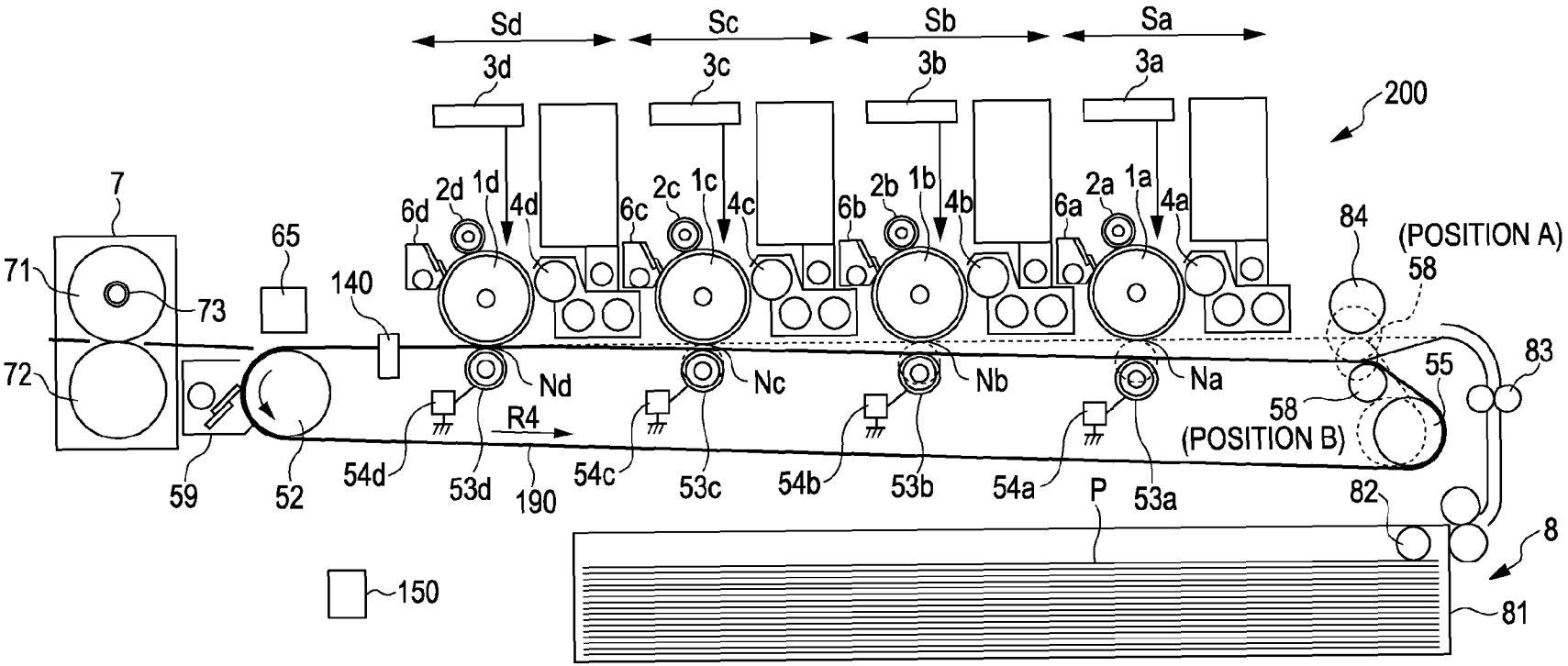
FIG. 14 is a schematic sectional view of the structure of an image forming apparatus according to a third embodiment of the present invention.
Figure 15:
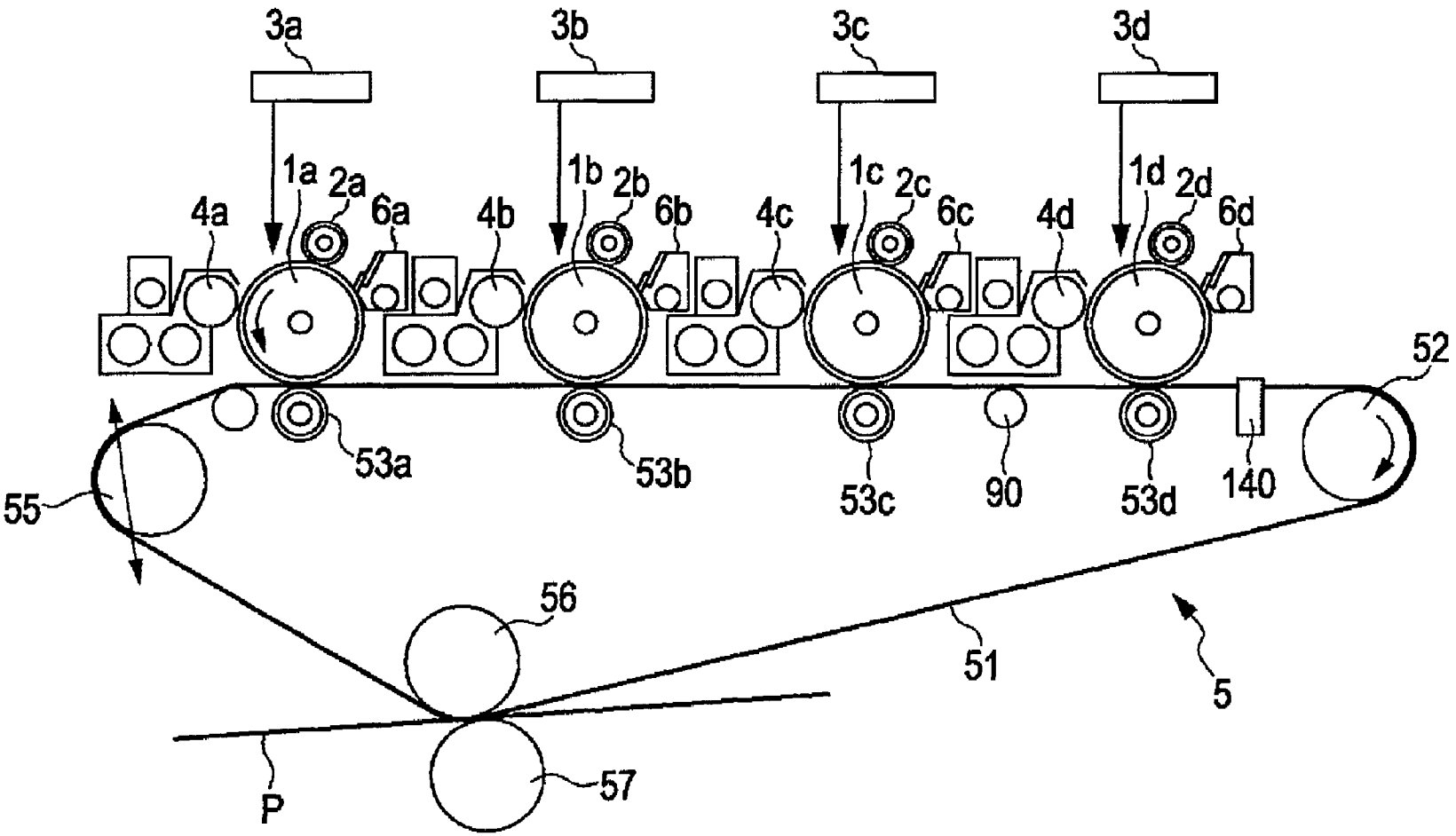
FIG. 15 is a schematic sectional view of the structure of a related image forming apparatus using a steering roller.
Figure 16:
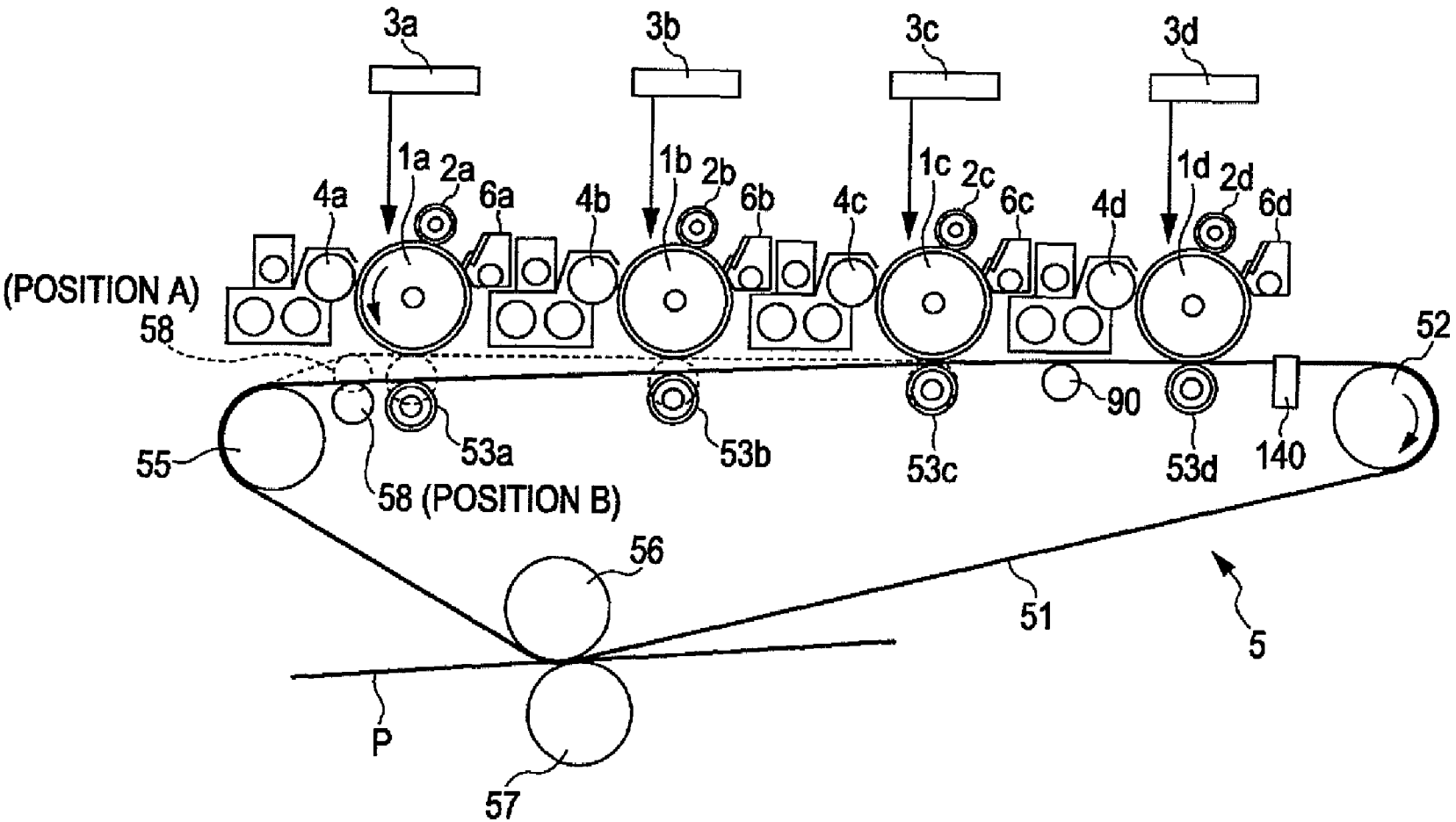
FIG. 16 is a schematic sectional view of the structure of a related image forming apparatus using a primary-transfer separating mechanism.

FIG. 14 is a schematic sectional view of the structure of an image forming apparatus 200 according to a third embodiment. The image forming apparatus 200 is a full-color electrophotography image forming apparatus using a direct transfer method.

In the image forming apparatus 200 according to the third embodiment shown in FIG. 14, components having substantially the same functions and structural features as those of the image forming apparatus 100 shown in FIG. 1 will be given the same reference numerals, and will not be described in detail below. In addition, in the image forming apparatus 200 according to the third embodiment, the structures of image forming sections Sa to Sd are substantially the same, and only differ in the toner colors that they use. Therefore, when it is not necessary to distinguish between them, the letters a, b, c, and d, included in their symbols to indicate what colors the image forming sections use, will be omitted, to generally describe the image forming sections.

The image forming apparatus 200 according to the third embodiment includes a rotatable belt member (recording-material supporting member), that is, a rotatable transfer belt (recording-material supporting belt) 190, disposed adjacent to photosensitive drums 1*a* to 1*d* of the respective image forming sections Sa to Sd. The transfer belt 190 is placed upon a driving roller 52, a steering roller 55, and an upstream regulating roller 58. The rollers 52, 55, and 58 serve as supporting members. The driving roller 52, serving as a belt driving device, transmits a driving force to the transfer belt 190, to rotate the transfer belt 190 in the direction of illustrated arrow R4.

Transfer rollers 53*a* to 53*d*, serving as transfer members, are disposed at positions opposing the respective photosensitive drums 1*a* to 1*d* at the inner peripheral surface side of the transfer belt 51. The transfer rollers 53*a* to 53*d* cause the transfer belt 190 to be biased towards the photosensitive drums 1*a* to 1*d*, and transfer portions (transfer nip portions) Na to Nd, where the photosensitive drums 1*a* to 1*d* and the transfer belt 51 contact each other, are formed.

In the image forming apparatus 200 according to the third embodiment, images formed on the photosensitive drums 1*a* to 1*d* at the image forming sections Sa to Sd are successively multiplexed and transferred onto a transfer material P, such as a sheet, on the transfer belt that passes a region adjacent to the photosensitive drums 1*a* to 1*d*.

In forming an image, a transfer-material supplying device 8 conveys the transfer material P to the transfer belt 51. That is, in the transfer-material supplying device 8, transfer materials P taken out one at a time by a pickup roller 82 from a cassette 81 (serving as a transfer-material container) are conveyed towards the transfer belt 51 by, for example, a conveying roller 83. Then, the transfer material P is electrostatically attracted to the transfer belt 51 by an attracting device 84, and conveyed to transfer sections of the image forming sections Sa to Sd.

For example, in forming a full-color image, toner images of respective colors are formed on the photosensitive drums 1*a* to 1*d* of the respective first to fourth image forming sections Sa to Sd. Transfer bias is applied to the toner images of the respective colors from the respective transfer rollers 53*a* to 53*d* opposing the photosensitive drums 1*a* to 1*d* with the transfer material P and the transfer belt 190 being disposed between the photosensitive drums 1*a* to 1*d* and the respective transfer rollers 53*a* to 53*d*. This causes the toner images of the respective colors to be successively transferred onto the transfer material P on the transfer belt 190.

When the transfer process at each of the transfer sections Na to Nd is completed, the transfer material P receives a separation bias of a separation/electricity removal member 65, is separated from the transfer belt 51, and is conveyed to a fixing device 7.

For example, any toner (transfer remaining toner) remaining on the transfer belt 190 after the transfer process is removed and collected by a transfer belt cleaner 59.

Here, similarly to the intermediate transfer belt 51, the transfer belt 190 may be formed of a dielectric resin, such as polycarbonate (PC), polyethylene terephthalate (PET), or polyvinylidene fluoride (PVDF). In the third embodiment, the intermediate transfer belt 190 is formed of polyimide (PI) resin having a surface resistivity of $10^{14}\Omega/\square$ (probe conforming to JIS-K6911 used; applied pressure=1000 V; application time=60 sec; 23° C./50% RH), and a thickness of 80 μm. However, the present invention is not limited thereto, so that other materials having different volume resistivities and thicknesses may be used.

The transfer rollers 53 according to the third embodiment have structures similar to those of the aforementioned primary transfer rollers 53. Each transfer roller 53 comprises a core metal having an outside diameter of 8 mm, and a conductive urethane sponge layer having a thickness of 4 mm. The electrical resistance of each transfer roller 53 is approximately $10^{6.5}\Omega$ (23° C./50% RH). The electrical resistance of each transfer roller 53 is determined from an electrical current value measured by rotating each transfer roller 53, which contacts a metallic roller connected to ground under a load of 500 g weight, at a peripheral speed of 50 mm/sec, and applying a voltage of 100 V to each core metal.

The steering roller 55 is a hollow cylindrical aluminum roller having an outside diameter of 30 mm and a wall thickness t=2 mm.

The upstream regulating roller 58 is a hollow cylindrical aluminum roller having an outside diameter of 16 mm and a wall thickness t=2 mm.

Intermediate Transfer Belt Removing Mechanism and Operation of Steering Roller

Next, a mechanism for removing the transfer belt 190 from the photosensitive drums, and the operation of the steering roller 55 caused by the removing mechanism will be described.

The image forming apparatus according to the third embodiment includes a full color mode and a black single-color mode. The transfer belt 190 comes into contact with and separates from the photosensitive drums 1*a*, 1*b*, and 1*c* in accordance with the mode.

First, the operation of the image forming apparatus according to the third embodiment when it forms an image in the black single-color mode will be described in detail. In the black single-color mode, as shown by a solid line in FIG. 14, the transfer belt 190 contacts only the photosensitive drum 1*d*, and forms the transfer nip portion. The other photosensitive drums 1*a*, 1*b*, and 1*c* are separated from the transfer belt 190. Accordingly, while a transfer material P is supported and conveyed, only a black single-color image is transferred onto the transfer material P. Here, to lower the transfer belt 190, the upstream restricting roller 58 is disposed so as to be lowered to a position B indicated by a solid line in FIG. 14. When an attraction position of the transfer material P to the transfer belt 190 is lowered, a guiding member that guides the attracting roller 84 or the transfer material P to the transfer belt 51 also moves. The winding angle of the transfer belt 190 with respect to the steering roller 55 is smaller in the black single-color mode than that in the full-color mode (described later). That is, the area of a portion of the transfer belt 190 wound upon the steering roller 55 is small. Since the mechanism of the steering roller 55 is similar to that used in the first embodiment, it will not be described in detail.

In the image forming apparatus according to the third embodiment, as shown in FIG. 14, a belt edge detector 140 is disposed near a front edge of the transfer belt 190. It is desirable that the belt edge detector 140 be provided at a location where the position of the intermediate transfer belt does not change when the transfer belt comes into contact with and separates from the photosensitive drums. Accordingly, in the third embodiment, the belt edge detector 140 is provided between the driving roller 52 and the transfer section for black. For the structure of the belt edge detector 140, the structure of the belt edge detector 140 according to either the first embodiment or the second embodiment can be used, so that it will not be described in detail.

By virtue of this structure, in the third embodiment, as with the first embodiment or the second embodiment, the belt edge detector 140 detects the position of the transfer belt 190, to correct the position by the steering roller 55. In addition, by virtue of this structure, in the operation in the black single-color mode, the relationship between the relative positions of the intermediate transfer belt 190 and the photosensitive drum 1*d* is maintained, thereby making it possible to mitigate the problems of image distortion or pull of the belt.

Next, the operation of the image forming apparatus according to the third embodiment when it forms an image in the full color mode will be described in detail. When an image is formed in the full color mode, the transfer belt 190 is disposed as indicated by a dotted line in FIG. 14. The transfer belt 190 come into contact with the photosensitive drums 1*a* to 1*d*, so that the transfer nip portions are formed, to successively transfer images of four colors. At this time, since the position of a surface of the transfer belt 190 is regulated so as to be parallel to the photosensitive drums 1*a* to 1*d*, the upstream regulating roller 58 is disposed at a position A.

The winding angle of the transfer belt 51 with respect to the steering roller 55 is smaller in the full color mode than in the black single-color mode. In the image forming apparatus according to the third embodiment, the winding angle of the intermediate transfer belt 51 with respect to the steering roller 55 is 160 degrees in the black single-color mode, and is 115 degrees in the full color mode. As a result, a force that the transfer belt 190 receives from the steering roller 55 is smaller in the full color mode than in the black single-color mode. Even in the third embodiment, similarly to the first embodiment or the second embodiment, the inclination angle of the steering roller 55 is controlled in accordance with the winding angle of the transfer belt 51 with respect to the steering roller 55, that is, in accordance with the area of a winding portion. As a result, even in the operation of the full color mode, the relationship between the relative positions of the transfer belt 190 and the photosensitive drums 1*a* to 1*d* is maintained, thereby allowing an image to be formed while reducing image detects such as image misregistration or color misregistration.

As described above, in the third embodiment, when the winding angle of the transfer belt 190 with respect to the steering roller 55 is changed due to the selected mode, the controlling of the inclination angle of the steering roller 55 is changed. In the third embodiment, as in the first embodiment, the controlling operations based on Tables 1 and 2 are carried out.

By virtue of this structure, an image forming apparatus that can reduce image misregistration without reducing the life of the belt can be obtained. Although the present invention is described in accordance with specific embodiments, it is to be understood that the present invention is not limited to the above-described embodiments.

For example, the relationship between the dispositions of the intermediate transfer belt or the transfer belt (that is, the belt member) and the rollers that support the belt (that is, the driving roller, the steering roller, and the upstream regulating roller) is not limited to those described in the embodiments. As long as the winding angle of the belt member with respect to the steering roller is changed in accordance with the mode, the present invention is applicable.

Although, in the above-described embodiments, the winding angle in the full color mode is smaller than the winding angle in the single color mode, even if the relationship between these angles is reversed, similar effects can be obviously obtained by carrying out similar controlling operations in accordance with the winding angle.

Further, in the embodiments, the operations in the black single-color mode in the apparatus for forming images of four colors, yellow, magenta, cyan, and black are described in detail. However, the present structure is applicable to an image forming apparatus using colors other than the aforementioned four colors or using a light-colored toner. In addition, the present structure is similarly applicable to an apparatus including image forming sections that form images of four or more colors.

While the present invention has been described with reference to exemplary embodiments, it is to be understood that the invention is not limited to the disclosed exemplary embodiments. Various modifications may be made within the technical concept according to the present invention. The scope of the following claims is to be accorded the broadest interpretation so as to encompass all modifications and equivalent structures and functions.

This application claims the benefit of Japanese Application No. 2007-156394 filed Jun. 13, 2007, which is hereby incorporated by reference herein in its entirety

What is claimed is:

1. An image forming apparatus comprising:

a first image bearing member and a second image bearing member, toner images being formed on the first and second image bearing members;

a belt member capable of contacting the first and second image bearing members;

a moving member configured to move a surface of the belt member to produce a first state, in which the belt member contacts the first and second image bearing members, and a second state, in which the belt member contacts the second image bearing member and separates from the first image bearing member;

a supporting roller rotatably contacting the belt member, an area of contact of the supporting roller and the belt member being changed by the movement of the moving member; and a supporting roller inclination device configured to incline the supporting roller to move the belt member in a rotational axis direction of the supporting roller, wherein an inclination angle of the supporting roller with respect to a predetermined belt position while the area of contact of the supporting roller and the belt member is small is larger than an inclination angle of the supporting roller with respect to the predetermined belt position while the area of contact of the supporting roller and the belt member is large.

2. The image forming apparatus according to claim 1, wherein the supporting roller inclination device causes a maximum value of the inclination angle of the supporting roller in the first state to differ from a maximum value of the inclination angle of the supporting roller in the second state.

3. The image forming apparatus according to claim 2, wherein the maximum value is larger when the area of contact of the supporting roller and the belt member is smaller.

4. The image forming apparatus according to claim 1, wherein the area of contact of the supporting roller and the belt member in the first state is smaller than the area of contact of the supporting roller and the belt member in the second state.

5. The image forming apparatus according to claim 1, wherein the second image bearing member is configured to form a black toner image.

6. The image forming apparatus according to claim 1, wherein the moving member is disposed between any one of the image bearing members and the supporting roller in a direction of a rotation of the belt member.

7. The image forming apparatus according to claim 1, further comprising a position detecting member configured to detect a position of the belt member in the rotational axis direction, wherein the position detecting member detects the position of the belt member in an area where a position of the surface of the belt member is the same when the moving member moves.

8. The image forming apparatus according to claim 1, wherein the belt member is an intermediate transfer member configured to bear the toner images.

9. The image forming apparatus according to claim 1, wherein the belt member is configured to support and convey a recording material.

10. An image forming apparatus comprising:

a first image bearing member and a second image bearing member, toner images being formed on the first and second image bearing members;

a belt member capable of contacting the first and second image bearing members;

a moving member configured to move a surface of the belt member in a direction orthogonal to a direction of rotation of the belt member to produce a first state, in which the belt member contacts the first and second image bearing members, and a second state, in which the belt member contacts the second image bearing member and separates from the first image bearing member;

a supporting roller rotatably contacting the belt member, an area of contact of the supporting roller and the belt member being changed by the movement of the moving member; and a supporting roller inclination device configured to incline the supporting roller to move the belt member in a rotational axis direction of the supporting roller, wherein the supporting roller inclination device causes a maximum value of an inclination angle when the area of contact of the supporting roller and the belt member is small to be larger than a maximum value of an inclination angle when the area of contact of the supporting roller and the belt member is large.

11. The image forming apparatus according to claim 10, wherein the supporting roller inclination angle causes the maximum value of the inclination angle of the supporting roller in the first state to differ from the maximum value of the inclination angle of the supporting roller in the second state.

12. The image forming apparatus according to claim 11, wherein the maximum value is larger when the area of contact of the supporting roller and the belt member is smaller.

13. The image forming apparatus according to claim 10, wherein the area of contact of the supporting roller and the belt member in the first state is smaller than the area of contact of the supporting roller and the belt member in the second state.

14. The image forming apparatus according to claim 10, wherein the second image bearing member is configured to form a black toner image.

15. The image forming apparatus according to claim 10, wherein the moving member is disposed between any one of the image bearing members and the supporting roller in a direction of a rotation of the belt member.

16. The image forming apparatus according to claim 10, further comprising a position detecting member configured to detect a position of the belt member in the rotational axis direction, wherein the position detecting member detects the position of the belt member in an area where a position of the surface of the belt member is the same when the moving member moves.

17. The image forming apparatus according to claim 10, wherein the belt member is an intermediate transfer member configured to bear the toner images.

18. The image forming apparatus according to claim 10, wherein the belt member is configured to support and convey a recording material.

* * * * *